US006691714B1

(12) United States Patent
Yaguchi et al.

(10) Patent No.: US 6,691,714 B1
(45) Date of Patent: Feb. 17, 2004

(54) WEARER'S OWN HAIR UTILIZING TYPE WIG AND METHOD FOR MANUFACTURING THE SAME

(75) Inventors: Toshio Yaguchi, Tokyo (JP); Yoshihiko Isobedate, Tokyo (JP); Katsuo Sugai, Tokyo (JP); Sakiko Imai, Tokyo (JP); Ryuji Yamakawa, Tokyo (JP); Shinkichi Kojima, Tokyo (JP)

(73) Assignee: Aderans Co., Ltd., Tokyo (JP)

( * ) Notice: Subject to any disclaimer, the term of this patent is extended or adjusted under 35 U.S.C. 154(b) by 0 days.

(21) Appl. No.: 09/689,641

(22) Filed: Oct. 13, 2000

(30) Foreign Application Priority Data

Apr. 19, 2000 (JP) ..... 2000-117867
Jul. 31, 2000 (JP) ..... 2000-232093

(51) Int. Cl.[7] ..... A41G 3/00
(52) U.S. Cl. ..... 132/201; 132/53; 132/56
(58) Field of Search ..... 132/201, 53, 54, 132/56

(56) References Cited

U.S. PATENT DOCUMENTS 670,857 A * 3/1901 Dorenwend ..... 132/53
1,040,425 A * 10/1912 Samuel ..... 132/53
3,273,570 A * 9/1966 Allison ..... 132/53
3,435,832 A * 4/1969 Ito ..... 132/53
3,645,279 A * 2/1972 Imre ..... 132/53
3,812,867 A * 5/1974 Wanderman et al. ..... 132/53
3,868,959 A * 3/1975 Koh ..... 132/53
4,171,001 A * 10/1979 Leonard et al. ..... 132/53
4,600,029 A * 7/1986 Ueberschaar ..... 132/53
5,010,914 A * 4/1991 Merges ..... 132/53
5,406,971 A * 4/1995 Taylor ..... 132/201
5,551,452 A * 9/1996 Barlow ..... 132/53
6,494,212 B1 12/2002 Yamakoshi ..... 132/53

FOREIGN PATENT DOCUMENTS

EP 0400215 5/1990

* cited by examiner

*Primary Examiner*—Todd E. Manahan
(74) *Attorney, Agent, or Firm*—Westerman, Hattori, Daniels & Adrian LLP

(57) ABSTRACT

This invention relates to a wearer's own hair utilizing type wig in which the wearer's own hair is pulled up through a space in the wig and blended with false hairs at the time for attaching the wig to the wearer and in which the wearer's own hair can be effectively and evenly utilized, thus enabling to provide an abundance of hair as a whole. Particularly, the wig (1, 2, 3) comprises a hair-secured frame (10, 20, 30) which includes a skeleton-like framework and false hairs (15) attached to the skeleton-like framework. That is, a wig of the present invention comprises a hair-secured frame (10, 20, 30) having no perimeter, the hair-secured frame including a skeleton-like framework and a plurality of false hairs (15) attached to the skeleton-like framework, the skeleton-like framework including a plurality of ribs (13, 18) combined in such a manner as not to form an outline of the wig, for attachment, the wearer's own hair (H) being pulled up through a space of the hair-secured frame (10, 20, 30) and blended with the false hairs (15) attached to the ribs (13, 18).

62 Claims, 29 Drawing Sheets

(A)

(B)

WEARER'S OWN HAIR UTILIZING TYPE WIG AND METHOD FOR MANUFACTURING THE SAME

TECHNICAL FIELD

This invention relates to a wearer's own hair utilizing type wig in which the hair growing on the wearer's head is pulled up through the wig and blended with false hairs attached to the wig, and more particularly to a wearer's own hair utilizing type wig in which a plurality of wearer's own hairs can be pulled up evenly and easily.

RELATED ART

Conventional wigs, in general, are formed by attaching a number of false hairs to a wig base which defines an overall configuration, i.e., outline of the wig. Among them, the so-called wearer's own hair utilizing type wigs are of the type in which a plurality of holes or meshes are formed in a wig base and the wearer's own hair is pulled up and out through those holes or meshes and blended with the false hair of the wig. A typical example of a conventional wig of this type is shown in FIG. 35.

A wearer's own hair utilizing type wig 70 in FIG. 35 employs a net base 71 composed of a coarse net member. The wig 70 is known to employ a net shape of cross meshes such as a diamond shape, a rectangular shape and the like. Such a vertical and horizontal cross arranged net base 71 has a number of false hairs 72 (FIG. 35 shows only a part of the false hairs) preliminarily attached thereto. As a material of the false hair, human hair, or artificial hair composed of synthetic fiber is used in general. In this specification, hair materials composed of humans' hairs or synthetic fibers attached to a wig are referred to as "false hairs".

In the case where the wearer's own hair utilizing type wig is attached to a wearer's head, the wearer's own hair H is pulled up through a space of the net base 71 using a hairdressing brush, then the wearer's own hair H thus pulled up and out are blended with the false hairs 72. By doing so, the wig can be attached to the wearer's head utilizing the wearer's own hairs.

However, when the above wearer's own hair utilizing type wig 70 is attempted to be attached to the wearer's head, much of the wearer's hair is pressed against the net base with the underside of the vertical and horizontal net base 71 and therefore, much of the wearer's own hair H pressed downward is kept secured by the net base 71. Even if the hairs H are tried to be pulled up and out using the hairdressing brush, they are not easily pulled up and out of the net meshes with the result that much of the wearer's own hair H is left non-utilized. Moreover, when the tips of the teeth of the comb enter the mesh, they are readily caught by the mesh. The result is that the net base 71 is torn off or broken by undue force required for withdrawing the brush.

Furthermore, in the case of the conventional wig base in FIG. 35, the net member must be vertically and horizontally disposed in order to maintain the curved state. Accordingly, it is essentially required for the conventional wig base to be equipped with a peripheral edge framed member 73. That is, the peripheral edge of the wig base must be reinforced by the peripheral edge framed member 73 which defines the configuration and size of the wig. This peripheral edge framed member 73 is normally trimmed, in order to prevent the shape from being deformed, such that its peripheral edge portion is comparatively thick and rigid, by means of a wide cloth tape, polyurethane resin coating or the like. As a result, the wig 70 must be attached to the wearer's head with the wearer's own hair H being pressed with the net member and the peripheral edge framed member 73. The peripheral edge framed member 73 acts very adversely when the downwardly pressed wearer's own hair H is pulled upward. Moreover, since the wearer's head is somewhat compressed tightly by the peripheral edge framed member, the perspiration from the scalp is prevented.

A more vital disadvantage of the peripheral edge framed member which is an essential component part of the conventional wearer's own hair utilizing type wig is that the peripheral edge framed member is readily discovered by a third party. In the case where the wearer's own hair utilizing type wig is designed as a partial wig or hairpiece in FIG. 35, this partial wig exhibits a shallow bowl-like configuration. Therefore, when such a partial wig is placed on the wearer's head, the peripheral edge framed member 73 is laterally arranged, particularly at the forehead portion of the wearer's head, along the hairline. Since the peripheral edge framed member 73 is arranged in a laterally crossing direction at the forehead portion of the wearer's head, generally over a half length of the full circumference of the wearer's head, it is very easy to be discovered. In addition, since the wearer's own hair H grown at the forehead region is pressed by the underside of the peripheral edge framed member 73, the hairline does not mix evenly with the wig 70, thus the front edge of the wig 70 is floated, providing an unnatural look. This further enhances the easy discovery of the peripheral edge of the wig. Moreover, since the false hairs 72 attached to the peripheral edge framed member 73 are greatly different in hair flow direction from that of the wearer's own hair H depending on hair style, it is difficult to blend the false hair 72 with the wearer's own hair H. As a result, the false hair 72 and the wearer's own hair H must be blended by proving a curl thereto using a permanent instrument such as an iron, a drier or the like. Therefore, it requires much time and labor to obtain a desired hairstyle.

The presence of the peripheral edge framed member can also create a problem with the wearer's rear head portion. Because the wearer's hair in the rear head region is pressed by the peripheral edge framed member 73, the peripheral edge 74 of the wig 70 is floated. This causes the generation of a step between the false hairs 72 of the wig and the wearer's own hair H, and the border appears as a step-like stripe along the peripheral edge 74. Hence, the fact of wearing a wig is visually recognized.

It is, therefore, an object of the present invention to provide a wearer's own hair utilizing type wig, in which much of the wearer's own hair can easily be pulled up and out in which the hair volume can be increased, as a whole, by blending the wearer's own hair with the false hairs of the wig and evenly effectively utilizing the wearer's own hair.

The second object of the present invention is to provide a wearer's own hair utilizing type wig, in which the peripheral edge of the wig is not easily visually recognized by eliminating the peripheral edge framed member and the bowl- or cap-like wig base such as a net or artificial skin.

The third object of the present invention is to provide a method for manufacturing the above-mentioned wearer's own hair utilizing type wig.

The fourth object of the present invention is to provide a rib comprised of a core material composed of an elastic rigid material and a thermally-contracting tube covering the core material which is designed such that false hairs can easily be attached thereto.

The fifth object of the present invention is to provide a wearer's own hair utilizing type wigO which is equipped, as a part thereof, with a rib comprising the core material and the tube.

DISCLOSURE OF THE INVENTION

In order to achieve the objects, a wearer's own hair utilizing type wig according to the present invention comprises a hair-secured frame having no perimeter, the hair-secured frame including a skeleton-like framework and a plurality of false hairs fixed to the skeleton-like framework, the skeleton-like framework including at least one rib curved in such a manner as not to form an outline of the wig, for attachment, the wearer's own hair being pulled up through a space of the hair-secured frame and blended with the false hairs secured to the skeleton-like framework.

According to another embodiment of the present invention, a wearer's own hair utilizing type wig comprises a hair-secured frame having no perimeter, the hair-secured frame including a skeleton-like framework and a plurality of false hairs secured to the skeleton-like framework, the skeleton-like framework including a plurality of ribs combined together in such a manner as not to form an outline of the wig, for attachment, the wearer's own hair being pulled up through a space of the hair-secured frame and blended with the false hairs secured to the skeleton-like framework.

According to a further embodiment of the present invention, a wearer's own hair utilizing type wig comprises a hair-secured frame having no perimeter, the hair-secured frame including a skeleton-like framework and a plurality of false hairs attached to the skeleton-like framework, the skeleton-like framework including a combination of a plurality of ribs extending forward and/or backward in correspondence with at least a forehead portion and/or a rear head portion for the wearer, for attachment, the wearer's own hairs being pulled up through a space of the hair-secured frame and blended with the false hairs attached to the skeleton-like framework.

According to a still further embodiment of the present invention, a wearer's own hair utilizing type wig comprises a hair-secured frame having no perimeter, the hair-secured frame including a skeleton-like framework and a plurality of false hairs secured to the skeleton-like framework, the skeleton-like framework including a plurality of ribs extending forward and/or backward and at least one connecting rib crossing for connection with each of the plurality of ribs at least at one point, for attachment, the wearer's own hair being pulled up through a space of the hair-secured frame and blended with the false hairs attached to the skeleton-like framework.

According to a wearer's own hair utilizing type wig of the present invention, it comprises a U- or V-shaped hair-secured frame unit having no perimeter, the U- or V-shaped hair-secured frame including a skeleton-like framework and a plurality of false hairs secured to the skeleton-like framework, the skeleton-like framework including a rib curved in a U- or V-shape in such a manner as not to form an outline of the wig, for attachment, the U- or V-shaped hair-secured frame unit being inserted towards the wearer's head portion first with a free end side thereof and the wearer's own hair being blended with the false hairs.

In the alternative, a wearer's own hair utilizing type wig may comprise a hair-secured frame including a plurality of U- or V-shaped hair-secured frame units having no perimeter and arranged in parallel such that the hair-secured frame exhibits a comb-like configuration as a whole, each of the U- or V-shaped hair-secured frame units including a skeleton-like framework and a plurality of false hairs secured to the skeleton-like framework, the skeleton-like framework including a rib curved into a U- or V-shape, for attachment, the comb-like hair-secured frame being inserted towards the wearer's head portion first with a free end side thereof and the wearer's own hair is blended with the false hairs.

Moreover, a wearer's own hair utilizing type wig according to the present invention comprises an annular hair-secured frame unit which includes an annular framework and a plurality of false hairs secured to said annular framework, for attachment, the said annular hair-secured frame unit is placed on the wearer's head, and the wearer's own hair is pulled up through an opening thereof and blended with the false hairs.

In the alternative, a wearer's own hair utilizing type wig may comprise a hair-secured frame, the hair-secured frame including at least two hair-secured annular frame units connected together in parallel, each of the hair-secured annular frame units including an annular framework and false hairs secured thereto, for attachment, the hair-secured frame being placed on the wearer's head and the wearer's own hair being pulled up and out of an opening of each of the hair-secured frame units and blended with the false hairs.

According to another embodiment of the present invention, a wearer's own hair utilizing type wig comprises an annular peripheral edge framed member and a plurality of ribs, the ribs each comprising a core material which is composed of an elastic rigid material and a thermally-contracting tube covering the core material, the peripheral edge framed member having a plurality of support holes formed in an inner peripheral edge corresponding to the wearer's forehead portion or rear head portion, the support holes being adapted to support the ribs, opposite end portions of the ribs being inserted into the support holes and supported by the peripheral edge framed member, the peripheral edge framed member and the ribs having false hairs attached thereto, for attachment, wearer's own hair being pulled up through a space between the ribs and blended with the false hairs.

In the alternative, the present invention may comprise an annular peripheral edge framed member and a plurality of ribs, the ribs each comprising a core material which is composed of an elastic rigid material and a thermally-contracting tube covering the core material, the ribs being attached to the peripheral edge framed member such that the ribs extend back and forth in a region surrounded with an inner peripheral edge of the peripheral edge framed member, a guide thin wire being arranged at each opposite side of the peripheral edge framed member, a movable slide rib being disposed along the guide thin wire, the peripheral edge framed member, the ribs and the slide rib being secured with false hairs, for attachment, the wearer's own hair being pulled up through a space between the ribs and blended with the false hairs.

Furthermore, the present invention may comprises an annular peripheral edge framed member and a plurality of ribs, the ribs each comprised of a core material which is composed of an elastic rigid material and a thermally-contracting tube covering the core material, the ribs being arranged in a mutually crossing relation within a region surrounded with an inner peripheral edge of the peripheral edge framed member, the ribs being attached to the peripheral edge framed member without being connected at crossing points thereof so that the ribs can freely exhibit elasticity thereof without being interfered within in their mutual actions, the peripheral edge framed portion and the ribs being attached with false hairs, for attachment, wearer's own hair being pulled up through a space between the ribs and blended with the false hairs.

According to a further embodiment of the present invention, a wearer's own hair utilizing type wig comprises a net member or a wig base composed of an artificial skin and a plurality of false hairs secured in the wig base, the wig base being formed at a portion thereof with a cutout portion, a rib, which comprises a core material composed of an elastic rigid material and a thermally-contracting tube covering the core material, being disposed over the cutout portion, the rib being secured with false hairs, for attachment, the wearer's own hair being pulled up through the cutout portion and blended with the false hairs secured to the rib and the wig base.

On the other hand, according to one embodiment of a method for manufacturing a wearer's own hair utilizing type wig of the present invention, the method comprises the steps of forming a planar skeleton-like framework having no outline by connecting together a plurality of ribs and at least one connecting rib by proper means such as bonding, knotting, welding and the like along a predetermined framework pattern; placing the skeleton-like framework on a given head mold having a predetermined configuration and at the same time retain the same curve along the configuration of the head mold; molding a curved framework, which is curved along the configuration of a given head mold, by heating, for a predetermined time, the ribs at a temperature for the material forming the ribs to be thermally changed; and forming a hair-secured frame by attaching a plurality of false hairs to the curved framework.

It is also accepted that a groove is formed in the head mold along the predetermined. framework pattern, and the planar skeleton-like framework is securely set in the groove.

According to a further embodiment of a method for manufacturing a wearer's own hair utilizing type wig of the present invention, the method comprises the steps of forming a groove in a head mold having a predetermined configuration along a predetermined framework pattern; pouring molten material forming a rib into the groove and hardening the same, thereby forming a curved framework along the head mold; and forming a hair-secured frame by attaching a plurality of false hairs to the curved framework.

BRIEF DESCRIPTION OF DRAWINGS

The present invention will be best understood from the following detailed description taken in conjunction with the accompanying drawings which illustrate several embodiments of this invention. It should be noted, however, that the embodiments shown in the accompanying drawings are not intended to specify nor limit the present invention but they are used only for facilitating the explanation and easy understanding of the present invention.

In the drawings;

FIG. 8(A) is a perspective view and FIG. 8(B) is a side view of a rib used in the wig of FIG. 8(A);

FIG. 17(A) is a partly enlarged side view of a rib formed by coating a core material with a thermally-contracting tube, FIG. 17(B) is a sectional view taken on line A—A of FIG. 17(A) and FIG. 17(C) is a sectional view taken on line B—B of FIG. 17(A);

BEST MODE FOR CARRYING OUT THE INVENTION

Several embodiments of the present invention will be described specifically hereinafter with reference to the accompanying drawings.

Figure 1:
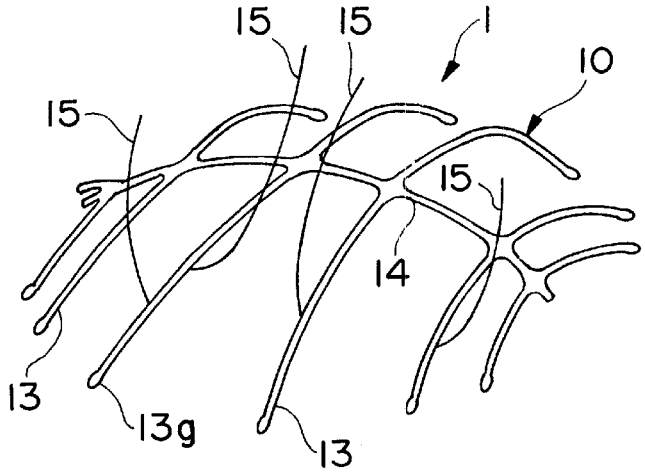
FIG. 1 is a perspective view showing a wearer's own hair utilizing type wig according to a first embodiment of the present invention, in which false hairs are mostly omitted for the sake of clarity of the construction of a framework, although a number of false hairs are actually densely attached to the framework.
Figure 2:
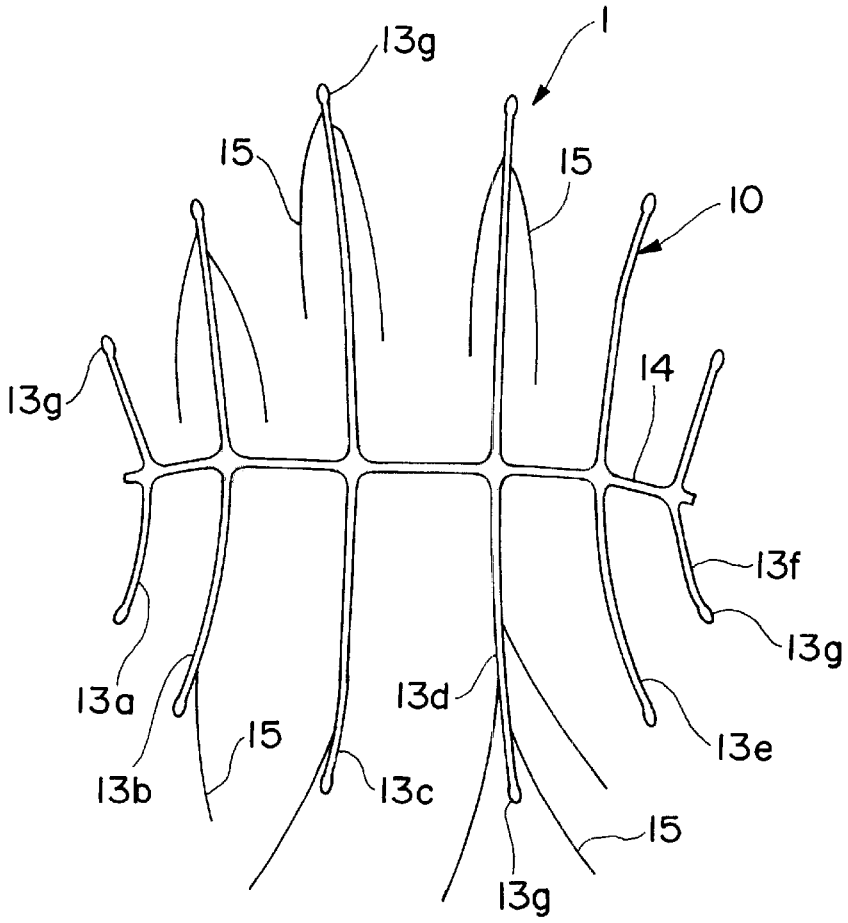
FIG. 2 is a top plan view of the wearer's own hair utilizing type wig shown in FIG. 1, in which the false hairs are likewise, mostly omitted.
Figure 3:
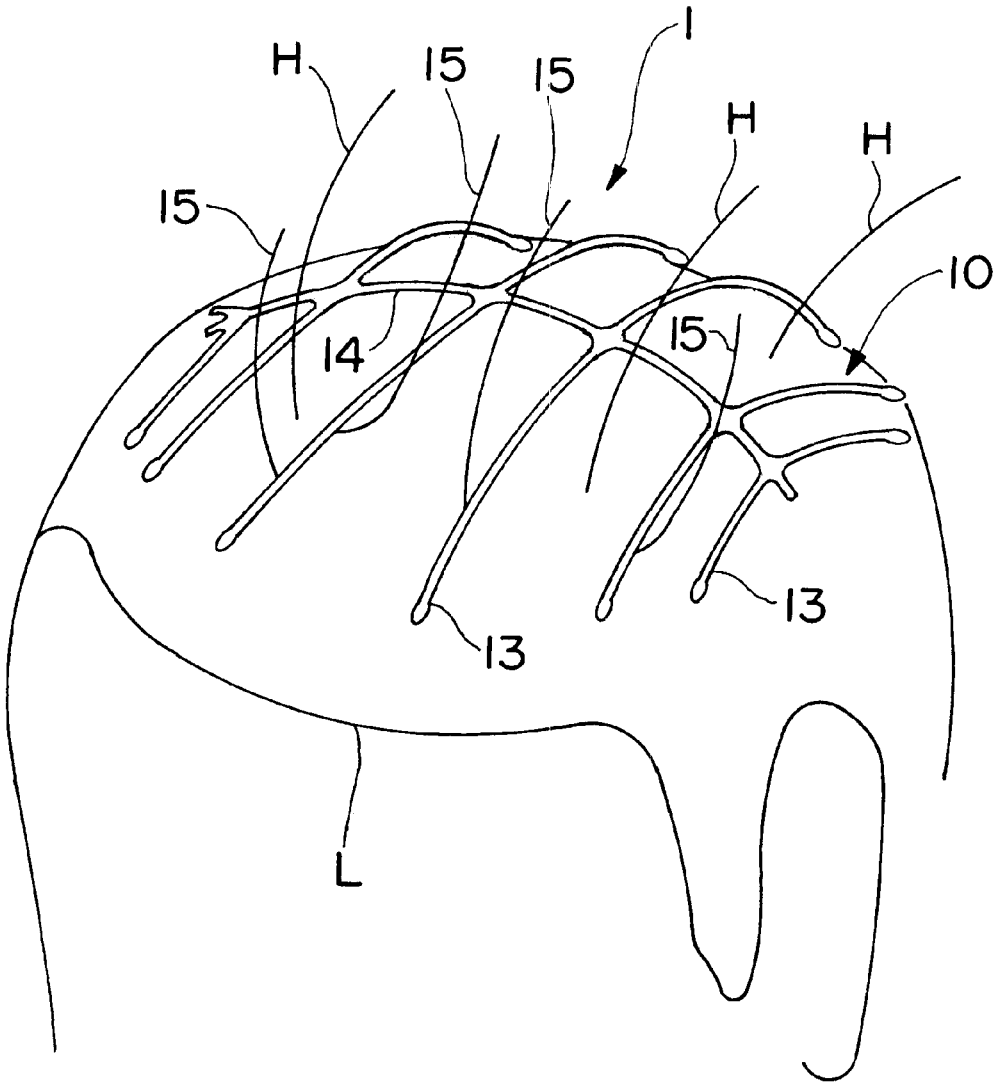
FIG. 3 is a perspective view showing a state in which the wearer's own hair utilizing type wig of FIG. 1 is attached to the wearer's head (it should be noted that actually, a number of false hairs attached to the framework are blended with the wearer's own hair)

FIGS. 1 to 3 are, respectively, a perspective view and a top plan view which show a wearer's own hair utilizing type wig 1 according to a first embodiment of the present invention and a perspective view showing a state in which the wearer's own hair utilizing type wig 1 is attached to the wearer's head. For attachment, this wearer's own hair utilizing type wig (hereinafter occasionally referred to simply as the "wig") is placed at a desired location of the wearer's head and false hairs 15 attached to a hair-secured frame 10 are blended with growing hair H of the wearer. By virtue of this arrangement, the wearer's own hair H can easily pulled up through a space of the hair-secured frame 10 and sufficiently blended with the false hairs 15 at the time of attachment.

In FIGS. 1 and 2, only a few of the false hairs 15 attached to the hair-secured frame 10 are illustrated and most of the false hairs 15 are omitted for the sake of clarity of the construction of a hair-secured frame 10, but actually, the number of the false hairs 15 are densely attached to the framework over an entire area thereof in such a manner as to project the total hair volume upward. For attachment, the wig 1 is placed on the wearer's head such that the upper side of FIG. 2 is located on the forehead portion of the wearer's head and the lower portion, on the rear head portion, respectively (see FIG. 3). The wig 1 is designed and dimensioned in such a way that the entire wig 1 covers, for example, a hair-reduced portion of the wearer's head. As shown in FIG. 1, the hair-secured frame 10 is extended downward at the top portion thereof so as to enable the hair flow to be curved along the configuration of the wearer's head. FIG. 3 shows a state in which the wig 1 is placed at the most common location of the wearer's head. It should be noted that although only a few of the wearer's own hair H project from the hair-secured frame 10 in this illustration, actually, much of the wearer's own hair H can be evenly pulled up through the wig 1 attached to the wearer's head.

As clearly shown in FIGS. 1 to 3, the wearer's own hair utilizing type wig 1 of the present invention comprises only the hair-secured frame 10 which is basically formed by attaching a number of false hairs 15 to a plurality of ribs 13.. A combination of the plurality of ribs 13 exhibits a skeleton-like framework, similar to the human rib cage, the bone pattern of a fish, or the vein pattern found in a leaf. This framework is constituted by combining thin bone-like extensions. In the example shown, six ribs 13*a* through 13*f* are arranged in a parallel position in a front to back direction of the wearer's head. These ribs 13*a* to 13*f* are dimensioned to be different in length such that the distal ends of the respective ribs are irregular at those areas in the vicinity of the forehead portion and the rear head portion, particularly in the vicinity of the forehead, the inner two ribs 13*c*, 13*d* being the longest and the length of the ribs being gradually reduced towards the outer ribs 13*a*, 13*f*.

In the case where the center ribs 13*c*, 13*d* are designed to be projected the most at their distal ends and those ribs 13*a*, 13*b*, 13*e*, 13*f*, which are located on the left and right sides of the center ribs 13*c*, 13*d*, to be gradually reduced in length as described above, the distal ends of the ribs 13*a* to 13*f* are arranged along the general hairline L (see FIG. 3). The number of the ribs 13 can be properly increased or decreased depending on how thick or thin the wearer's own hair H is. Also, the ribs may take a wide variety of patterns as will be later described in detail.

In order not to allow ribs 13*a* to 13*f* to become loosened or scattered, a connecting rib 14 is employed in this embodiment. As shown, for example, in FIGS. 1 and 2, the connecting rib 14 is formed in a generally linear configuration from the same material. The connecting rib 14 is disposed laterally across the lengthwise center of the ribs 13*a* to 13*f* which are mutually arranged parallel to each other and fixedly connected thereto. In this way, the skeleton of the hair-secured frame 10 is formed by properly combining the ribs 13*a* to 13*f* with the connecting rib 14 into a predetermined shape and connecting their crossing points by bonding, knotting, sewing, welding, or the like.

The pattern of the skeleton-like framework constituting the hair-secured frame 10 according to the first embodiment looks similar to that of a midrib and has veins branching like that of a leaf. The veins-like ribs 13*a* to 13*f* are connected to the midrib-like connecting rib 14 with an interval of about 1 to 2 cm between the adjacent ribs. As apparent from FIG. 2, the intervals between the adjacent ribs 13 are widthwise gradually enlarged towards the distal ends of the ribs 13. The weight of the skeleton-like framework constituting the hair-secured frame 10 ranges from 1 to 5 g at the most, depending on what material the framework is made of. In the case where the framework is made of a thin string of nylon having a diameter of about 1 mm similar to the gut of a tennis racket, for example, the weight of the framework ranges from 1 to 3 g. Even in a state in which the framework has the false hairs 15 densely attached thereto, the total weight of the framework is so light ranging from 5 to 10 g.

The skeleton-like framework is designed in such a way that there is no line defining an outline of a wig, as in the wig base which is an essential component part of the conventional wig. That is, the framework of the present invention does not include a peripheral edge frame or a perimeter whose external contour defines the outer configuration of the wig. Only the distal ends of the ribs are arranged in the area in the vicinity of the distal ends. The hair-secured frame 10 is formed by attaching the false hairs 15 to such a framework and it does not include the peripheral edge framed member 73 of the conventional wig 70.

The material of the ribs 13*a* to 13*f* and the connecting rib 14 is selected from those which do not have any risk of injuring the wearer's scalp or are hardly adversely affected by drier heat or the like. Preferred examples of material may include nylon (polyamide-based synthetic fiber) and a synthetic resin material such as polyester. In addition, other materials such as metal, hard paper, hard rubber, wood, bamboo, glass fiber, carbon fiber and the like which all have elasticity and rigidity can be used for this purpose. For example, in the case where the ribs and the connecting rib are composed of a twisted strand wire of nylon fibers having a diameter of about 0.1 to 3.0 mm, there can be obtained ribs having the desired rigidity and elasticity. Since a number of false hairs 15 are attached to such ribs 13, it is required for the material to have enough rigidity and elasticity to maintain the curved state along the configuration of the wearer's head against the total weight. It is more preferred if the ribs are formed from, for example, a shape memory resin which can be curved along the configuration of the wearer's scalp and is excellent in shape recoverability.

As shown in FIG. 2, the ribs 13, 14 are preferably formed at the distal ends each with a larger/thicker swollen part 13*g*. By forming the swollen part 13*g* in a generally ball-like configuration, the false hairs 15 attached to the ribs 13 can be prevented from escaping and the ribs themselves can also contact the wearer's scalp softly so as not to irritate it.

False hair fixed to the ribs 13, 14 implies either human hair or artificial hair having a diameter of about 0.05 to 0.2 mm, composed of nylon, polyester or the like, for example, is desirable. A number of such false hairs are attached to the ribs by knotting, sewing or winding in such a way that the false hairs project in a predetermined direction. The false hairs 15 may be the same color as the wearer's own hair H. If a more fashionable look is desired, a different color from that of the wearer's own hair H may be applied to the false hair 15. By doing so, the wig can be used as a fashionable wig.

Since the wearer's own hair utilizing type wig 1 according to the present invention is constituted in the manner as mentioned above, for attachment, as shown in FIG. 3, first, the wearer's own hair utilizing type wig 1 is placed on, the wearer's head and correctly positioned. The wig 1 is placed on the wearer's head in such a way that the distal ends of the ribs are offset a few centimeters towards the top side of the wig 1 away from the hairline L. Subsequently, the wearer's own hair H is pulled up and out. At the time when the blending operation is to occur, the hairs of the wig are brushed in a lengthwise direction of the ribs 13 using a brush or a comb, while pressing the wig 1 from above the wearer's head with one hand. By brushing the hairs on the front side forward and on the rear side backward with respect to the connecting rib 14, the wearer can pull up his or her own hair H, which is pressed by the wig 1, upward through the spaces between the ribs 13. Since the ribs 13 extend parallel to the brushing direction, the brush or the comb is never caught by the ribs 13 during brushing and the wearer's own hair H is never entangled with the ribs 13. Therefore, almost 100% of the wearer's own hair H can easily be pulled up through the space between the ribs 13. Moreover, by brushing the hairs towards the distal ends of the ribs 13, the ribs 13 are press-contacted with the wearer's scalp. This prevents the ribs 13 from floating upward. Even in the event the ribs 13 are floated upward by inadvertently brushing the hairs towards the basal ends from the distal ends, the ribs 13 can easily recover to the original shape rapidly along the configuration of the wearer's head because the ribs 13 have excellent elasticity and shape recoverability.

Then, the wearer's own hair H, as previously mentioned, is pulled up and out onto the outer surface of the hair-secured frame 10 of the wig 1 and lightly brushed with a hairdressing brush or the like, thereby dressing the hairs into a desired hairstyle while blending the wearer's own hair H with the false hairs 15. By doing so, the attachment of the wig to the wearer's head is completed. For the purpose of securing of the wig to the wearer's head, a known wig stopper may be employed. In that case, the stopper is fixed to the backside of the wig beforehand. Owing to a provision of the wig stopper, the wearer's own hair H can easily be fixed and held by the stopper.

Since the wearer's own hair utilizing type wig of the present invention is comprised of only the ribs 13 extending parallel to each other in a forth and back direction of the wearer's head at sufficient intervals and the connecting rib 14 is used for connecting the ribs 13, there is no lateral line, as is used by the conventional wig including the peripheral edge, formed along-periphery of the frame at the hairline or rear head portion of the wearer's head when the wig is attached. Accordingly, the fact of wearing a wig is not detected. Moreover, no division of hair occurs between the wearer's own hair H and the false hairs 72 particularly in the hairline region.

Furthermore, since the wearer's own hair utilizing type wig 1 according to the first embodiment does not include a peripheral edge framed member which defines the outer configuration of the conventional wig base, the wearer's own hair H can fully be pulled up through a space of the wig. The wearer's own hair H and the false hairs 15 get favorably intimate with each other by being well blended. By this, the hair-secured frame 10 is prevented from floating upward from the wearer's head particularly at the forehead portion or rear head portion of the wearer. Since the ribs 13 directly face particularly toward the wearer's forehead portion and the length of the ribs 13 are in fact irregular in that region, the growing edge or hairline of the wearer's head looks totally natural.

As mentioned above, since the wearer's own hair H can easily be pulled up in the wearer's own hair utilizing type wig 1 according to the first embodiment, the wearer's own hair H can fully be utilized and the hair H can easily blend in desired amounts with the false hairs 15. Since a natural look is established in the area in the vicinity of the peripheral edge without providing any feeling of disorder, the idea of wearing a wig is visually much less recognized. Moreover, since the skeleton of the hair-secured frame 10 is comprised of only a framework which is composed of a combination of ribs 13, 14, the wig has favorable breathability and the wig can be designed very light in weight.

The above wig 1 can be used by both men and women. In addition, it can be used as a nice accenting fashionable wig. In any case, since the wearer's own hair can easily be pulled up and out, the wearer's own hair can fully be utilized. Accordingly, there can be obtained a natural-looking hairstyle in which the false hairs can easily blend with the wearer's own hair and further provides no feeling of disorder at the growing edge or hairline along the perimeter edge of the wig.

Next, a wearer's own hair utilizing type wig 2 according to a first modified embodiment of the first embodiment of the present invention will be described with reference to FIGS. 4 and 5.

Figure 4:
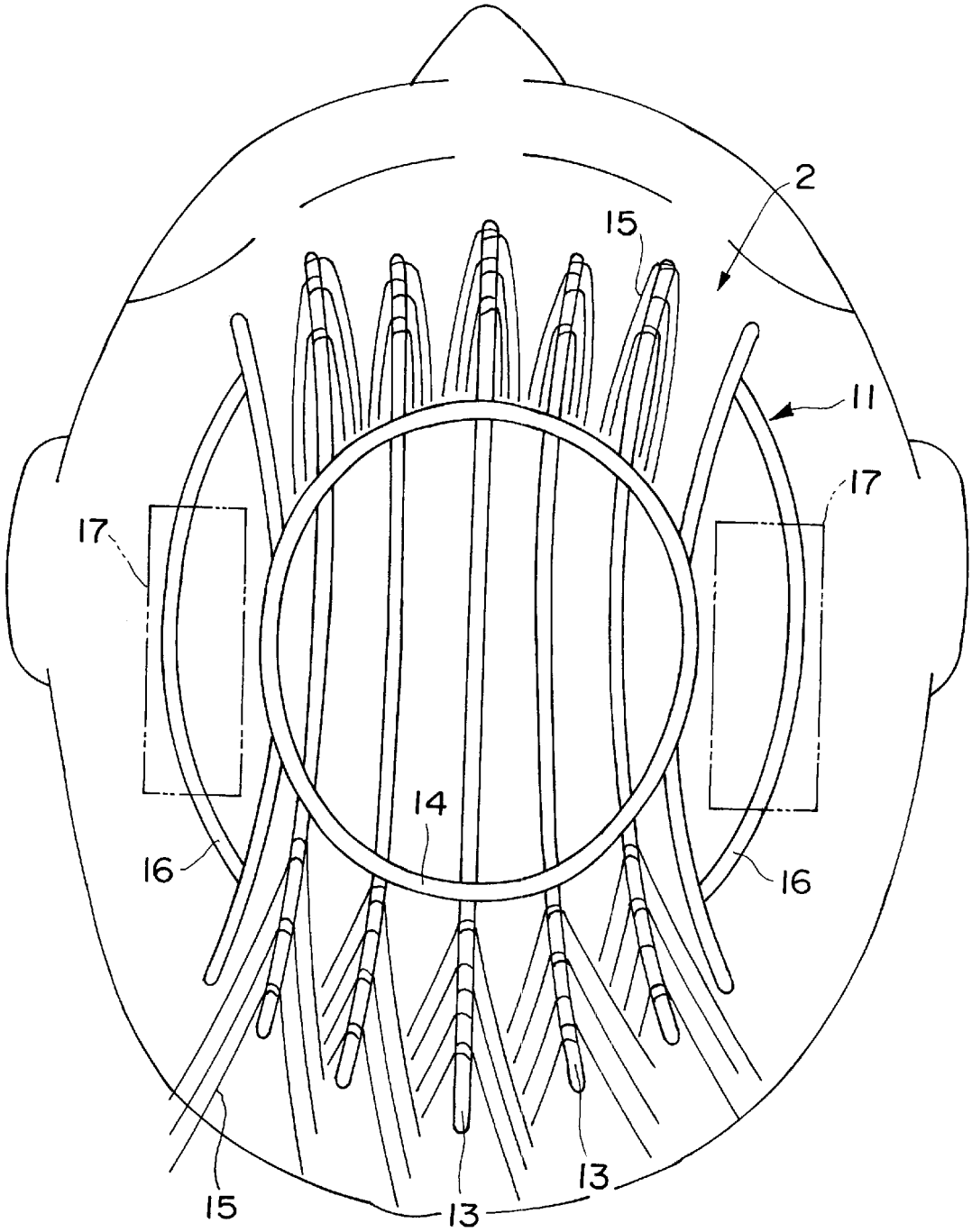
FIG. 4 is a schematic top plan view showing a constitution of a first modified embodiment of the first embodiment of the wearer's own hair utilizing type wig according to the present invention.
Figure 5:
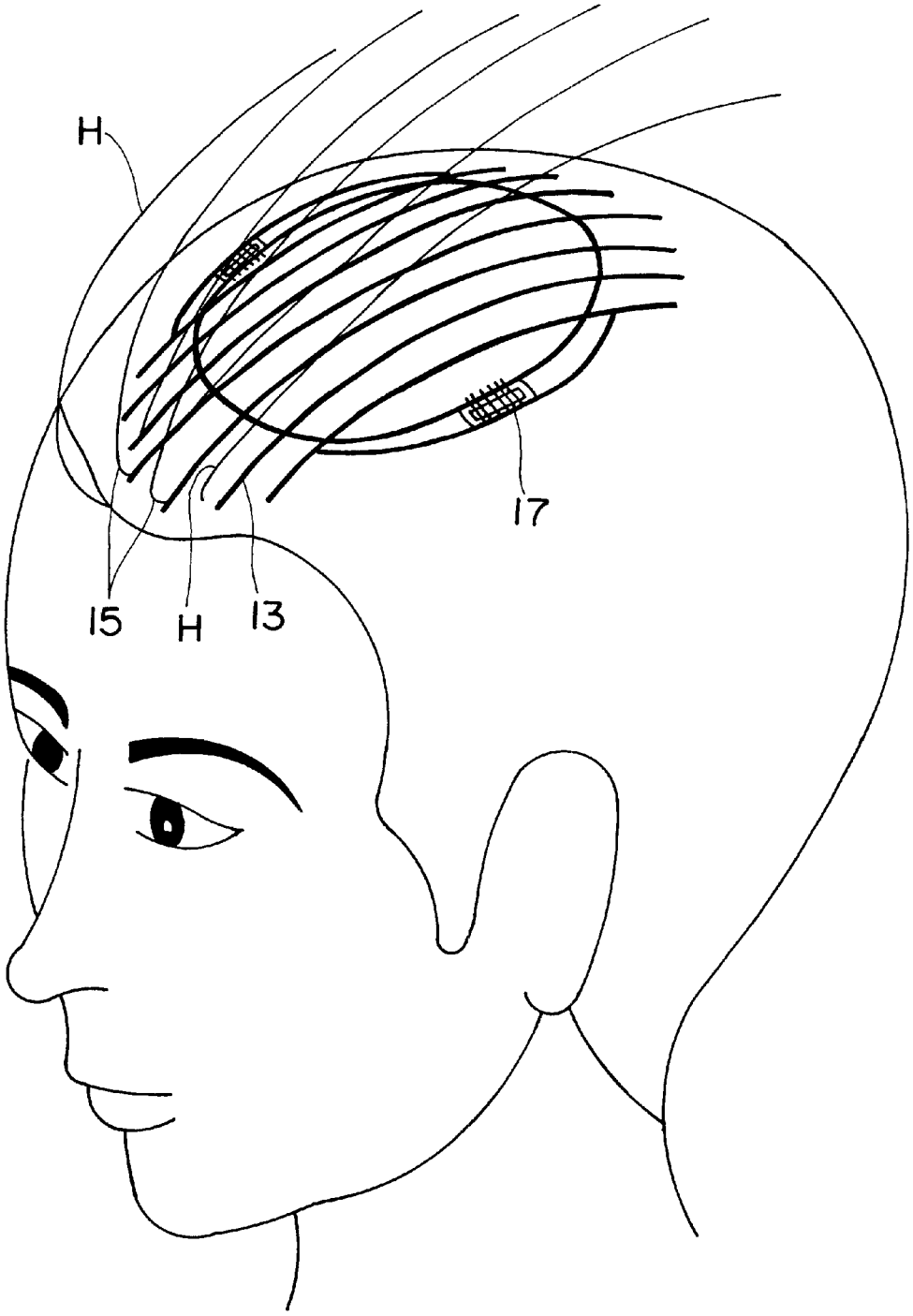
FIG. 5 is a perspective view showing the state in which the wig of FIG. 4 is attached to the wearer's head.

A hair-secured frame 11 of FIG. 4 comprises a plurality of ribs 13 (seven ribs in the illustrated modification) extending generally parallel to each other at intervals in the upper and lower direction in FIG. 4, i.e., the front and back direction of the wearer's head and an annular connecting rib 14 crossing each of the ribs 13 at two points located inward from the opposite ends of the ribs 13. Owing to the feature that each rib 13 is connected at two points through the annular connecting rib 14, the framework can more firmly be retained in shape.

This framework further includes two auxiliary connecting ribs 16 curbed outward. Owing to this arrangement, the shape of the framework is more firmly retained and the framework is more intimately contacted with, particularly, the opposite left and right sides of the wearer's head. Moreover, as indicated by chain lines of FIG. 4, stoppers 17 to affix and retain a wearer's own hair utilizing type wig 2 on the wearer's head can be attached to the wig 2 utilizing the auxiliary connecting ribs 16. The ribs 13, annular connecting rib 14, and the auxiliary connecting ribs 16 are all composed of the same fine wire rod and have excellent rigidity and elasticity.

Since the wearer's own hair utilizing type wig 2 is constituted in the manner as mentioned above, for attachment, as shown in FIG. 5, first, the wearer's own hair utilizing type wig 2 is placed on the wearer's head and correctly positioned and the wearer's own hair H is fully pulled up and out by brushing. Thereafter, the wig 2 is restrained to the wearer's own hair through the stoppers 17 mounted in the vicinity of the peripheral edge of the hair-secured frame 11. As for the stoppers 17, for example, a nipping tool comprising a reversely rotatable base and a number of comb teeth as disclosed in Japanese Patent Publication No. S54-16785 (corresponding to U.S. Pat. No. 1,536,630) can desirably be used. Alternatively, the wig 2 may be secured to the wearer's head using a double faced adhesive tape, a liquefied medical instantaneous adhesive agent or the like.

A method for manufacturing the wearer's own hair utilizing type wig 1 will now be described using the wig 2 of FIG. 4 as an example.

Figure 6:
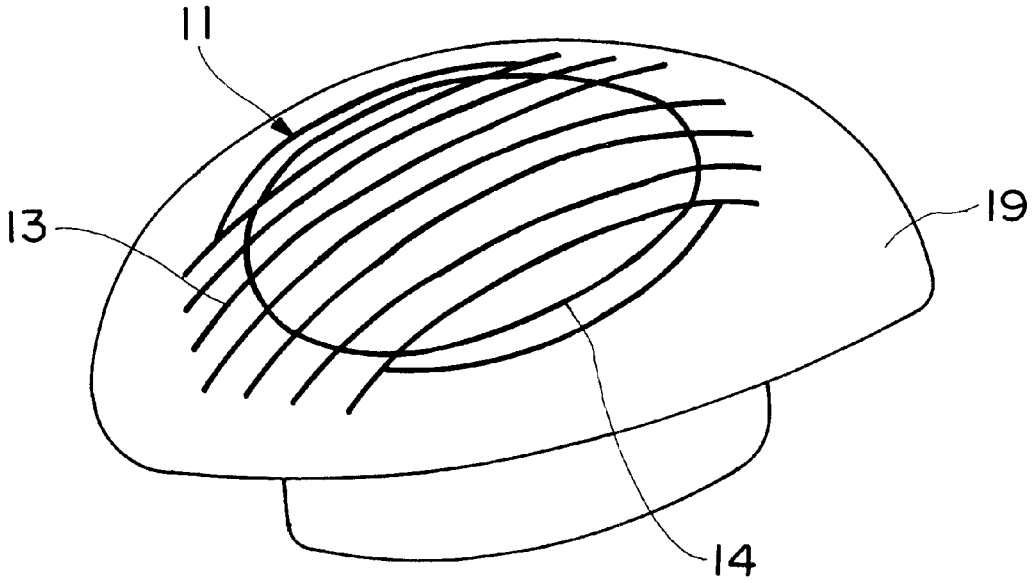
FIG. 6 is a perspective view showing one example of a method for manufacturing a wearer's own hair utilizing type wig according to the present invention as well as a process for molding the framework.
Figure 7:
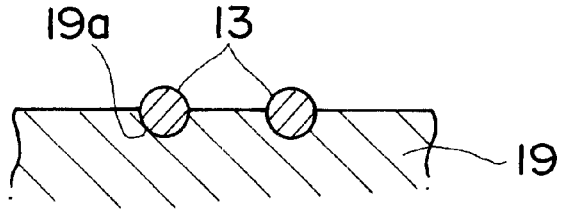
FIG. 7 is a cross sectional view showing the state in which the rib material is set on a gypsum head mold of FIG. 6.

First, as indicated by reference numeral 19 of FIG. 6, a gypsum head mold is made copying the head configuration so that it is preferably in conformity with the wearer's head configuration as much as possible. A desired framework pattern is written on this gypsum head mold 19. The ribs 13 and the annular connecting rib 14 are cut into a predetermined length and arranged along this pattern. Then, the crossing points are marked, respectively.

Then, the ribs 13 and the connecting rib 14 are connected together at the marked crossing points by an ultrasonic welding machine. In that state, a planar framework is formed.

Such an obtained planar framework is curved so as to be in conformity with the pattern drawn on the gypsum head mold 19 and fixed. Then, by heating the framework at a predetermined temperature for a predetermined amount of time, the framework is curved along the wearer's head configuration.

Lastly, the false hairs 15 are attached to the curved skeleton-like framework. By doing so, the hair-secured frame 11, namely, the wearer's own hair utilizing type wig according to the present invention is accomplished.

In the case where a fine wire rod made of a polyamide resin is used as the ribs 13, 14, the ribs 13, 14 are heated at about 150 degrees C. to 170 degrees C. ranging from 30 minutes to 4 hours. By doing so, the curved shape of the ribs is stabilized. The ribs 13, 14 are preferably transparent or translucent and colored in a skin tone or the same color as the false hairs 15. Moreover, the ribs are preferably subjected to surface roughening treatment using sandpaper or the like. By doing so, the surface gloss can be restrained and the attached false hairs 15 can be prevented from escaping.

In the case where a raindrop-like ball body (swollen part 13*g*) is formed on each opposite distal end of the ribs 13, 14, the distal ends of the ribs are dipped, for example, in a liquid resin, cooled and hardened.

It is also accepted that at the time of setting the planar framework on the gypsum head mold 19, a groove 19*a* is formed on the surface of the gypsum head mold 19 along the pattern of the curved skeleton-like pattern to be made, and the ribs 13, 14 are fitted in and securely fixed and retained by the grooves 19*a*. When the ribs 13, 14 received in the groove 19*a* are subjected to heat treatment, there can be obtained a framework which is not deformed at the time of heating and which has a stable predetermined configuration.

In the case where the hair-secured frame 11 is molded and made in this way, there can easily be manufactured the hair-secured frame 11 which is correctly in conformity with the configuration of the wearer's head and which hardly floats in an upward motion.

As another method for manufacture, the curved skeleton-like framework can be formed integrally by pouring, for example, a molten synthetic resin material into the groove 19*a* of the gypsum head mold 19 followed by a cooling and hardening process at the same time. Therefore, there is no need for connecting work at the crossing points.

A second modified embodiment of the first embodiment of the present invention will now be described with reference to FIG. 8. A wearer's own hair utilizing type wig shown in FIG. 8(A) has a framework which is constituted, as in the wearer's own hair utilizing type wig 1 of FIGS. 1 to 3, by combining a plurality of ribs 13 and connecting ribs 14. The ribs 13, which are vertically arranged parallel to each other, are bent outward and floated upward, as shown in FIG. 8(B), at their lengthwise midway parts 13*h*. The ribs 13 are curved towards the distal ends from the bent parts 13*h* along the configuration of the wearer's head so that the distal ends can contact the wearer's scalp. As apparent from the illustration, the ribs 13 are partly floated upward and separated from the wearer's scalp.

In the case where such a wearer's own hair utilizing type wig 3 is attached to the wearer's head, there can be provided a voluminous feeling because the ribs 13 are partly floated upward. For example, the false hairs 15 attached to the bent parts 13*h* are, as shown in FIG. 8(B), projected upward and then allowed to flow backward at the midway parts. This causes the hairs to be raised, thus enabling to provide a voluminous feeling. This wig 3 is would be most desirable when the wearer prefers to have an all-back hairstyle.

Figure 8:
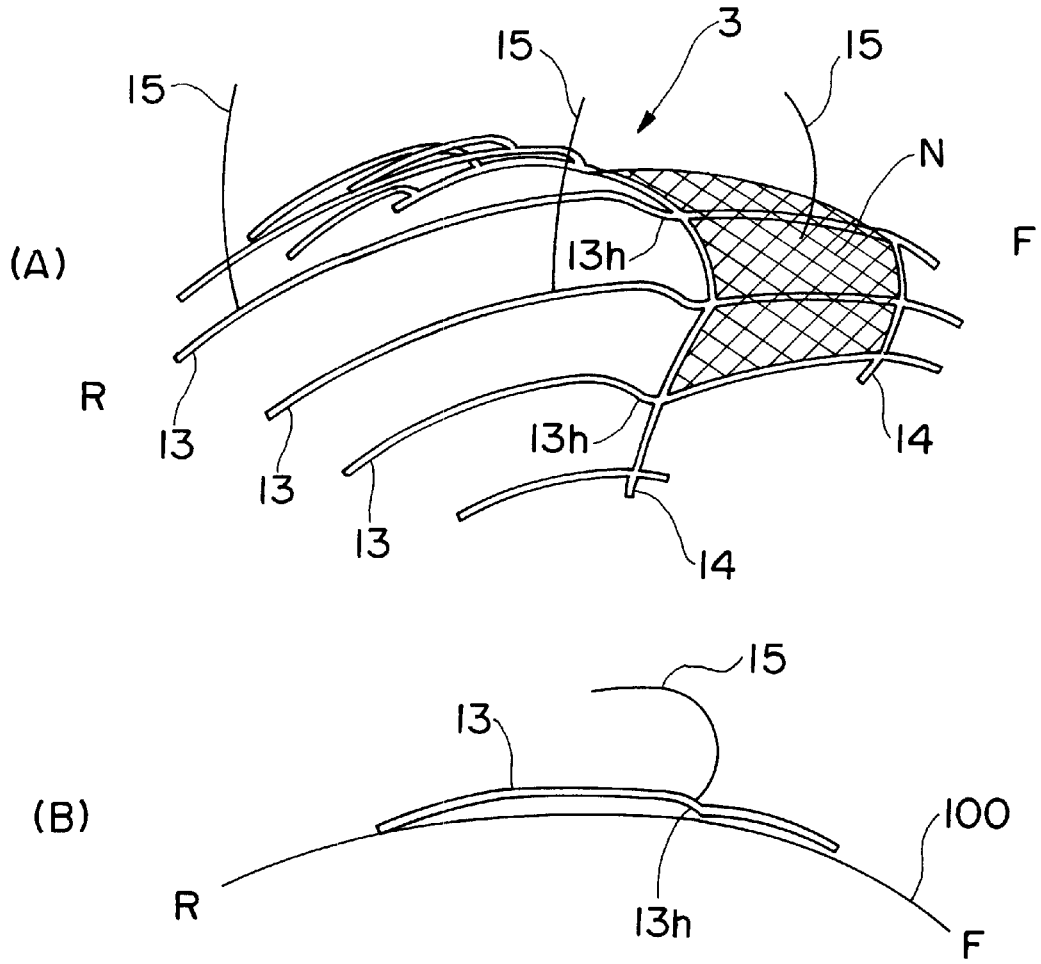
FIG. 8 is a perspective view showing a wearer's own hair utilizing type wig according to a second modified embodiment of the first embodiment of the present invention.

In FIG. 8, reference symbol F indicates a forehead portion and R, a rear head portion, respectively. In FIG. 8, two connecting ribs 14 are arranged on the forehead portion and a net member is stretched therebetween in order to thereby provide a hair-implanting region N. Owing to a provision of the hair-implanting region N, more false hairs 15 can be densely attached to this region.

As the framework, besides those of FIGS. 1, 4 and 8, the framework may be formed in a variety of patterns as shown in FIGS. 9 to 15. For example, the framework, which can be used in the present invention, can be formed in a wide variety of forms in accordance with the wearer's taste, such as a hair-dividing type which can cope with any style of hair division, a volume-enhancing type which is designed to increase hair volume, a hair flowing type which is suited for providing wide variety of hairstyles, a mixture type of all or some of them and the like. FIGS. 9 to 15 are top plan views showing a state in which the respective wigs are attached to the wearer's head. In these Figures, the false hairs 15 of the wigs and the wearer's own hair H is simplified.

Figure 9:
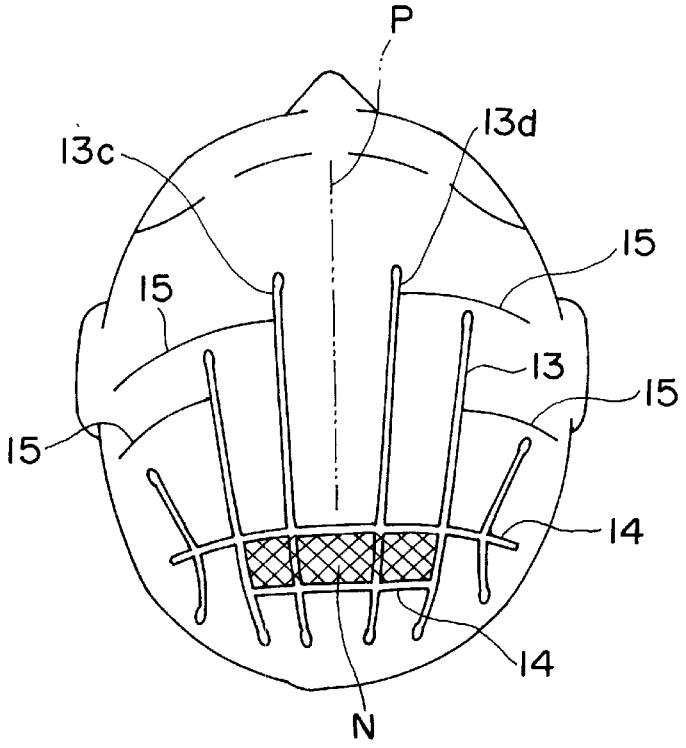
FIG. 9 is a top plan view showing a constitution of a skeleton-like framework according to another modified embodiment of the first embodiment of the present invention.

First, the wig shown in FIG. 9 is of the type in which the wearer's own hair growing at the hair-dividing section formed in a generally central area of the wearer's head can be utilized and the hair in the rear head portion is to be increased. For this purpose, as shown in FIG. 9, those two ribs 13*c*, 13*d* sandwiching a hair-dividing portion P (indicated by a two-dotted chain line in FIG. 9) of the wearer are arranged at a larger interval than the remaining ribs in order to facilitate the easy pull-out or usage of the wearer's own hair growing at the hair-dividing part P.

The ribs 13 are arranged generally parallel to each other in the front to and back direction. This wig is suited for a hairstyle in which the hair flow moves in a leftward and rightward cascade from the hair-dividing part. Moreover, in this framework, two connecting ribs 14 are disposed parallel to each other at the rear head portion and a net member is stretched at that region to provide a hair-implanting region N in order that false hairs can be densely attached thereto.

Figure 10:
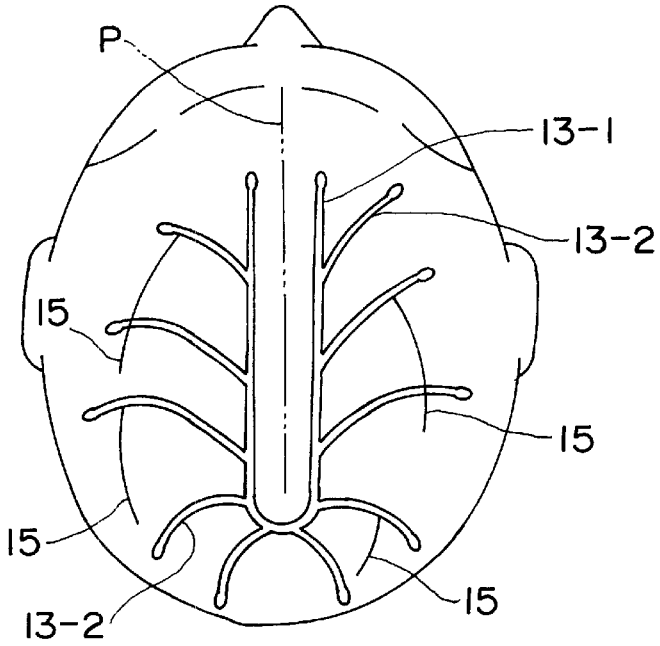
FIG. 10 is a top plan view showing a constitution of a skeleton-like framework according to a further modified embodiment of the first embodiment of the present invention.

The framework shown in FIG. 10 has a hair-dividing part P which is composed of the wearer's own hair and which is formed in a central section of the wearer's head as in FIG. 9. This arrangement is suited for the hairstyle in which all the hair on the wearer's head flows backward. For this purpose, the framework comprises, as shown in FIG. 10, a U-shaped rib 13-1 which is formed to have a width sufficient for sandwiching the hair-dividing part and a plurality of ribs 13-2 which are branched from the U-shaped rib 13-1, curved forward, leftward and rightward.

Figure 11:
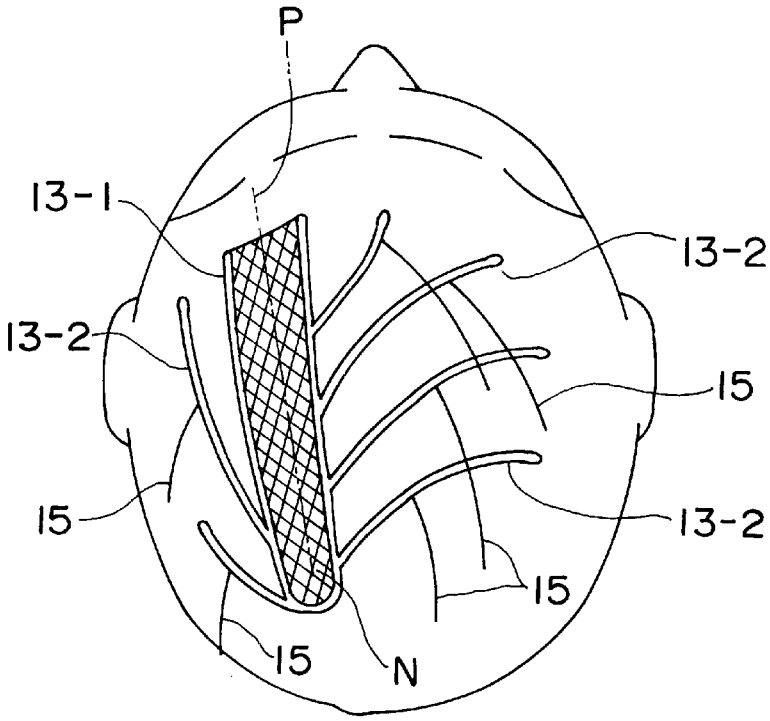
FIG. 11 is a top plan view showing a constitution of a skeleton-like framework according to a still further modified embodiment of the first embodiment of the present invention.

The framework shown in FIG. 11 is suited for the hairstyle in which the wearer's own hair has become too thin at the hair-dividing part P of the wearer is to be increased in number and the hair-dividing part P is located at the left side of the wearer's head, unlike those of FIGS. 9 and 10. This framework comprises a U-shaped rib 13-1 which is formed to have a width sufficient for sandwiching the hair-dividing part and a plurality of ribs 13-2 which are branched from the U-shaped rib 13-1. A net member is stretched along the hair-dividing part P to provide a hair-implanting region N. The false hairs 15 are secured to the hair-implanting region N so as to form the hair-dividing part P.

Figure 12:
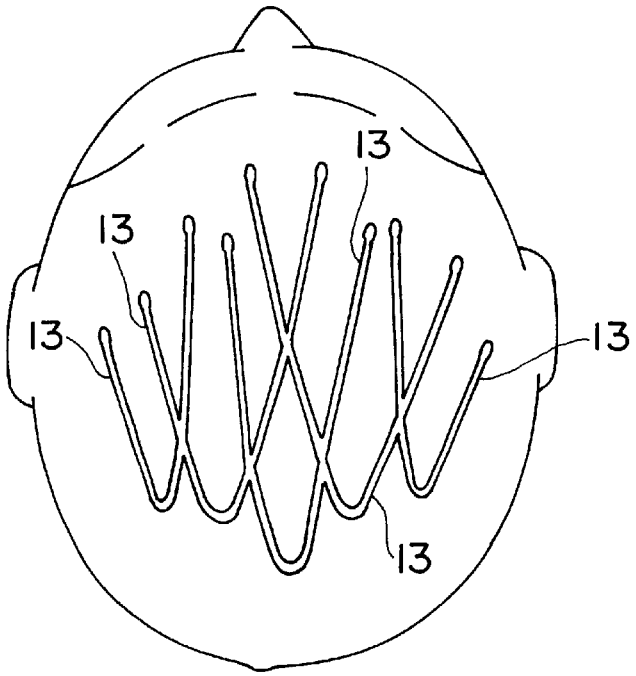
FIG. 12 is a top plan view showing a constitution of a skeleton-like framework according to a yet further modified embodiment of the first embodiment of the present invention.

FIGS. 12 to 15 chiefly show volume-enhancing type wigs. The wig shown in FIG. 12 is constituted by connecting a plurality of ribs 13 which are bent in a V-shape. Since an interval between the adjacent ribs 13 is reduced, false hairs 15 can densely be attached. In the framework shown in FIG. 12, since the ribs 13 are arranged over the entire head of the wearer, this framework is suited for the hairstyle in which the hair left on the wearer's head is very thinned out thus looking more for a fuller look.

Figure 13:
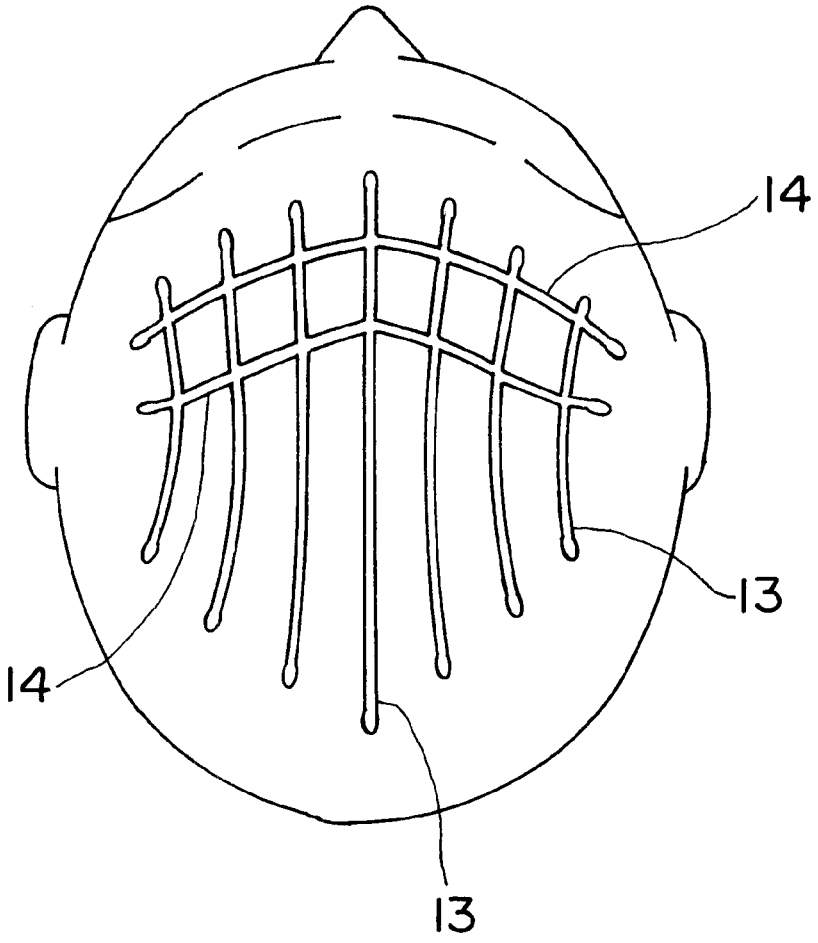
FIG. 13 is a top plan view showing a constitution of a skeleton-like framework according to an additional modified embodiment of the first embodiment of the present invention.

The wig shown in FIG. 13 is intended to volume enhance the hair on the forehead portion. This framework is constituted by combining the ribs 13, 14 such that an interval between the adjacent ribs 13 is reduced at the forehead portion. This framework is suited for an all back style in which hair flows backward.

Figure 14:
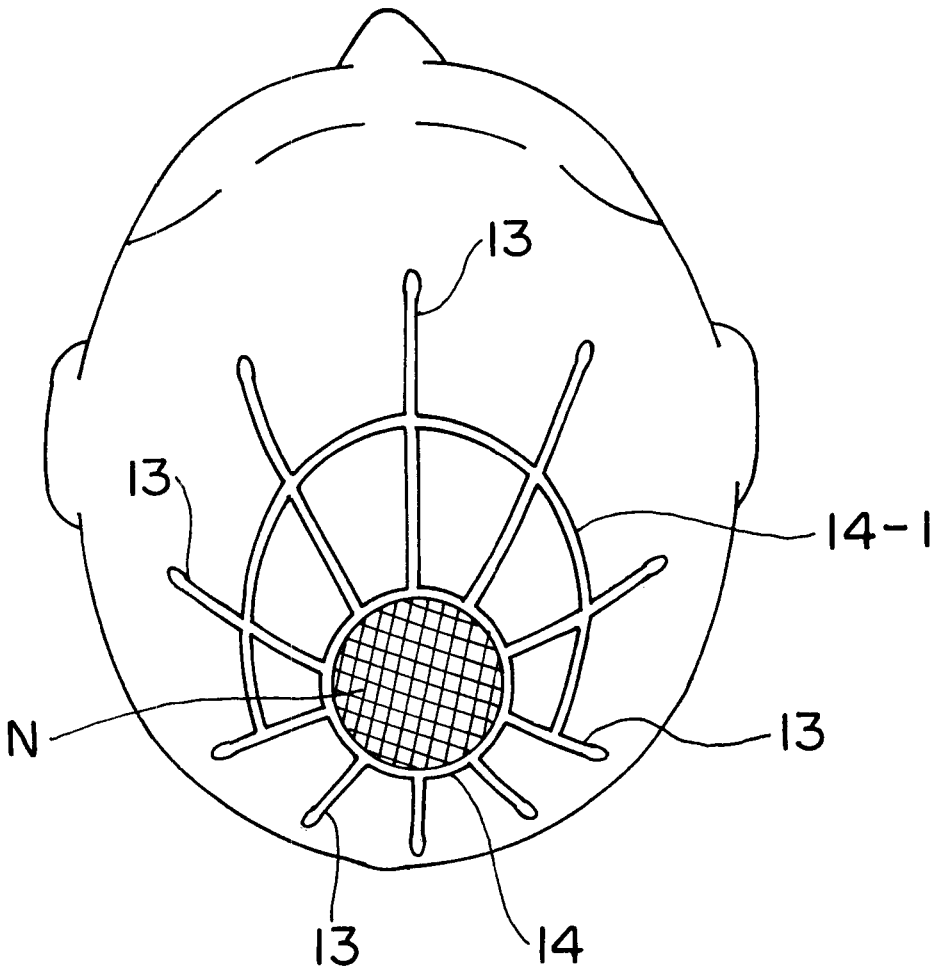
FIG. 14 is a top plan view showing a constitution of a skeleton-like framework according to another modified embodiment of the first embodiment of the present invention.

The wig shown in FIG. 14 is designed such that the ribs 13 located at the top are densely arranged so as to enhance the hair-increasing effect. This framework comprises an annular connecting rib 14 surrounding the whirl of hair on the wearer's head, a semi-annular connecting rib 14-1 arranged outside the annular connecting rib 14 and a plurality of ribs 13 radially extending from the annular connecting rib 14. It further comprises a net member stretched within the annular connecting rib 14 so as to provide a hair-implanting region N. False hairs 15 are attached to this hair-implanting region N in such a manner as to define the whirl. The wig shown in FIG. 14 is suited for a person whose remaining hairs are less at the top of the head, particularly at the whirl area and whose hair is also thinning in the area around the whirl.

Figure 15:
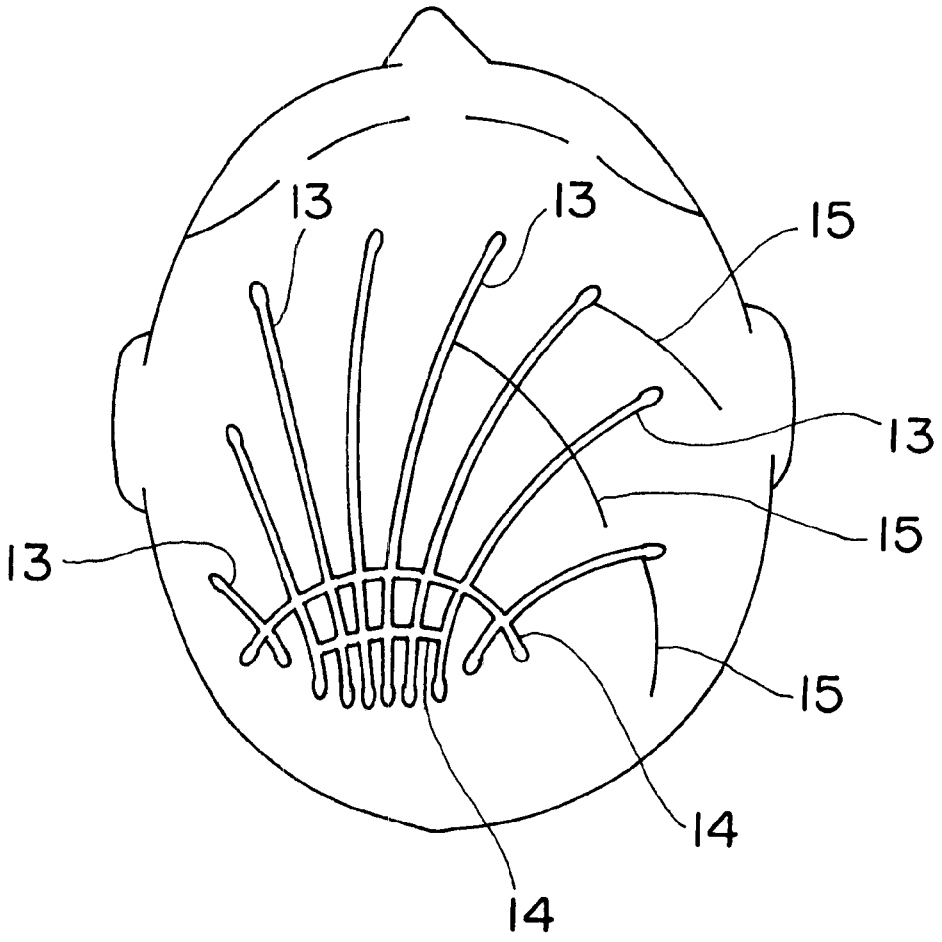
FIG. 15 is a top plan view showing a constitution of a skeleton-like framework according to a further modified embodiment of the first embodiment of the present invention.

The wig shown in FIG. 15 is of the type which is suited for the hairstyle in which hair remaining on the top of the wearer's head is less and the hairstyle flows from the side towards the back. In this framework, a plurality of ribs 13 bent in the hair flowing direction are connected to a connecting rib 14 and a proximate distance between the ribs 13 and the connecting rib 14 is reduced at the rear head part so that hair amount density is increased at the rear head portion.

As mentioned hereinbefore, the curved skeleton-like framework can be arranged in a variety of patterns. In any of them, the wearer's own hair can easily be pulled up and out by brushing the hair in the hair flow direction and the brush or comb is not caught by the ribs 13, 14 at the time of brushing.

The hair-implanting region N may be composed of artificial skin instead of a net member.

Needless to say, the framework can be designed in a wide variety of patterns other than those mentioned above. Moreover, the framework may be constituted by bending a long rib into a desired configuration without having a peripheral edge frame or a perimeter of the wig.

Figure 16:
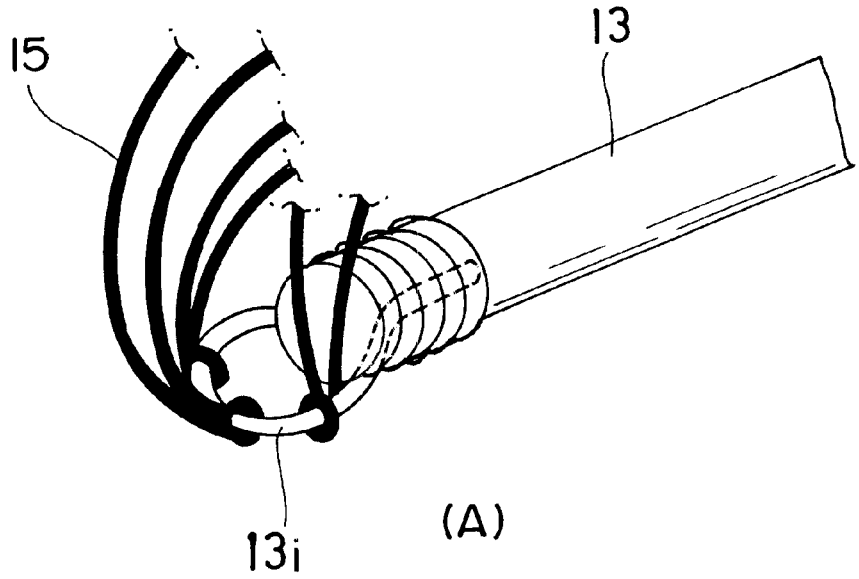
FIGS. 16(A)–(B) show one example of a rib used for the present invention and are partly enlarged perspective views showing states in which false hairs are attached to a loop formed on a distal end of the rib.
Figure 16:
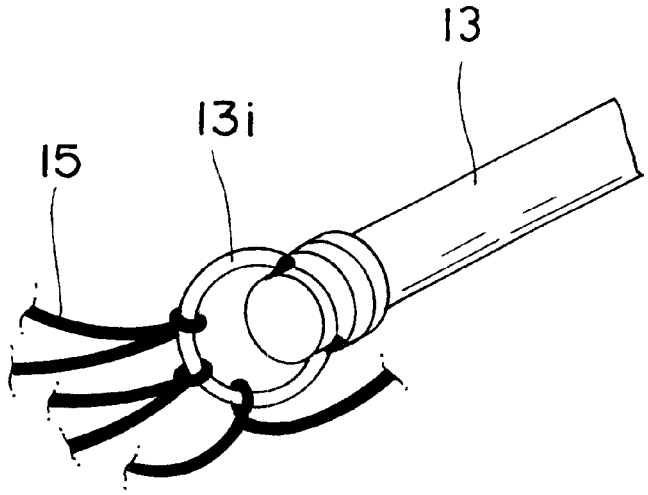

Several examples of a construction of the ribs constituting the frame member will now be described with reference to FIGS. 16 to 18.

The examples shown in FIGS. 16(A) and 16(B) are designed so as not to make conspicuous the distal end of the rib 13. Those Figures are partly enlarged perspective views showing a state in which the false hairs 15 are attached to a loop 13*i*. This loop 13*i* is formed by attaching one end of a wire rod to the distal end of the rib 13, projecting an intermediate section of the wire rod to form a ring and then, the other end is wound around the distal end of the rib 13 and fixing the same by an adhesive agent.

The loop 13*i* can be composed, for example, of the same material as the rib 13. The material of the loop 13*i* may be, for example, a synthetic resin material such as nylon and polyester which has both elasticity and rigidity and which is hardly adversely affected by a drier, etc., a metal wire rod and carbon fiber which has both elasticity and rigidity. Preferably, the wire rod composing the loop 13*i* is smaller in diameter than the rib 13.

The above loop 13*i* can be arranged in a horizontal position in relation to the wearer's scalp as shown in FIG. 16(A), or it can be arranged in vertical position in relation to the scalp as shown in FIG. 16(B). By attaching the false hairs 15 to the loop 13*i* in the manner as just described above, the distal end of the rib 13 can be hidden.

Next, a preferred rib, in which the false hairs 15 can be attached to its distal end without the need of a provision of the loop, will be described with reference to FIG. 17. This rib 18 is composed of a core material 18*a* and a thermally-contracting tube 18*b*. The rib 18 is constituted by serving the above rib 13 (14, 15) as the core material 18*a* and covering its entire periphery with the thermally-contracting tube 18*b*. FIG. 17(A) is a partly enlarged side sectional view showing a constitution of the rib 18 covered with the thermally-contacting tube 18*b*, FIG. 17(B) is a sectional view taken from line A—A of FIG. 17(A) and FIG. 17(C) is a sectional view taken from line B—B of FIG. 17(A).

Such a rib 18 covered with the thermally-contracting tube 18*b* (hereinafter occasionally simply referred to as the "tube") fully covers the distal end of the core material 18*a* and the remaining part of the rib 18 serves as a protrusion 18*c*. In that state, the false hairs 15 are implanted in the overall thermally-contracting tube 18*b* including the protrusion 18*c*. By this, since the distal end of the rib 18 is covered with false hairs 15, the rib 18 is more difficult to be visually recognized. The thermally-contacting tube 18*b* is preferably colored in a milk white color or in a similar color to the wearer's scalp or hair. By doing so, the rib 18, which is hidden by the wearer's own hair H and the false hairs, is more difficult to be visually recognized.

This thermally-contracting tube 18*b* is preferably composed of polyolefine, polyethylene or ethylene-propylene-rubber (E.P.R.). Moreover, the tube 18*b* preferably has a thermally-contacting property of at least 40% in the radial direction and 15% at the most in the axial direction at 100 degrees C. to 105 degrees C. The core material 18*a* preferably has a higher deforming temperature than the thermally-contracting tube 18*b*. In the case where the thermally-contracting tube 18*c* is used as an outer jacket of the rib 18, the false hairs 15 can be attached easily and reliably. For example, at the time of attaching the false hairs 15 to the thermally-contracting tube 18*b*, the false hairs 15 can easily be sewn thereto using a hair implanting needle. Even in the case where the false hairs 15 are attached to the thermally-contacting tube 18*b* by being wound therearound, they can be attached to the tube 18*b* reliably and without slipping because the tube 18*b* is abundant in elasticity.

FIGS. 18(A)–(C) are side views for explaining one example for manufacturing the rib 18 covered with the thermally-contracting tube 18*b*.

As shown in FIG. 18(A), the thermally-contacting tube 18*b* has a larger inside diameter than the outside diameter of the core material 18*a*. By inserting the core material 18*a* into the tube 18*b* before it is thermally contracted and heating the same at temperatures ranging from 100 degrees C. to 105 degrees C. for about ten minutes (for example, 5 minutes to 30 minutes), the tube 18*b* is thermally contracted and securely contacted with the core material 18*a*. At that time, since the tube 18*b* is longer than the entire length of the core material 18*a*, the remaining tube parts (protrusions) 18*c* protrude outward in their reduced-diameter states from opposite ends of the core material 18*a*. The tube 18*b* is preferably longer than the core material 18*a* in the manner as mentioned above. The surface of the rib 18 after subjected to heat treatment is glossy although it has the property of an elastic rubber. Therefore, in order to dull the surface of the rib 18, it is preferably rubbed into a dull state of FIG. 18(C) using a file or the like. By doing so, there can be provided a camouflaging effect. The glossy surface of the rib 18 may be made dull by means of chemical treatment as well.

Instead of the above rib 18 of a duplex construction, it is also accepted that a net material such as, for example, a lace tape, or the like is wound around the surface of the rib 13 and the false hairs 15 are knotted to the net material or the like. In the alternative, instead of the net material, it is also accepted that another tape in the form of a film or thin sheet composed of urethane or the like is wound around and adhesively attached to the rib 13 and then, the false hairs 15 are knotted to or implanted in the tape.

Figure 17:
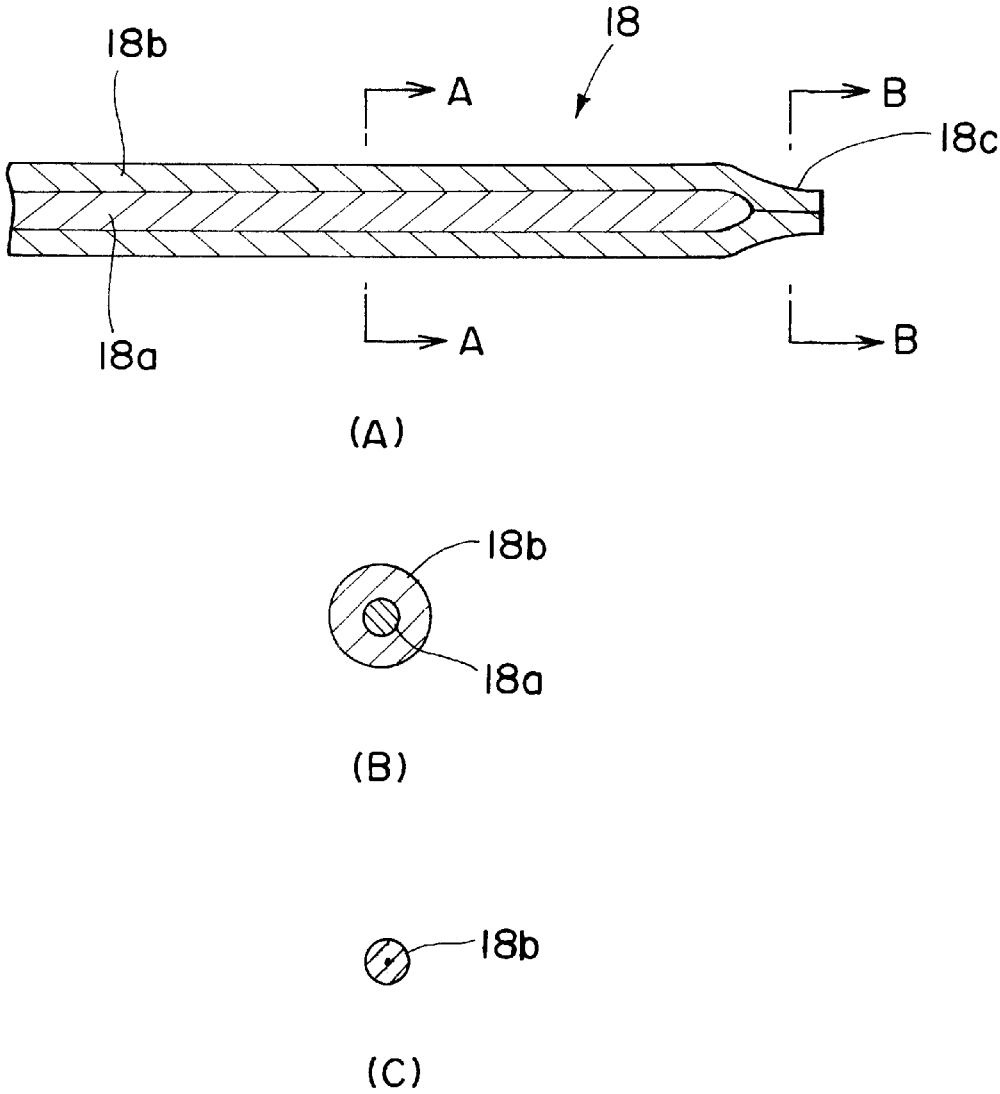
FIGS. 17(A)–(C) show one example of a rib used for the present invention.
Figure 18:
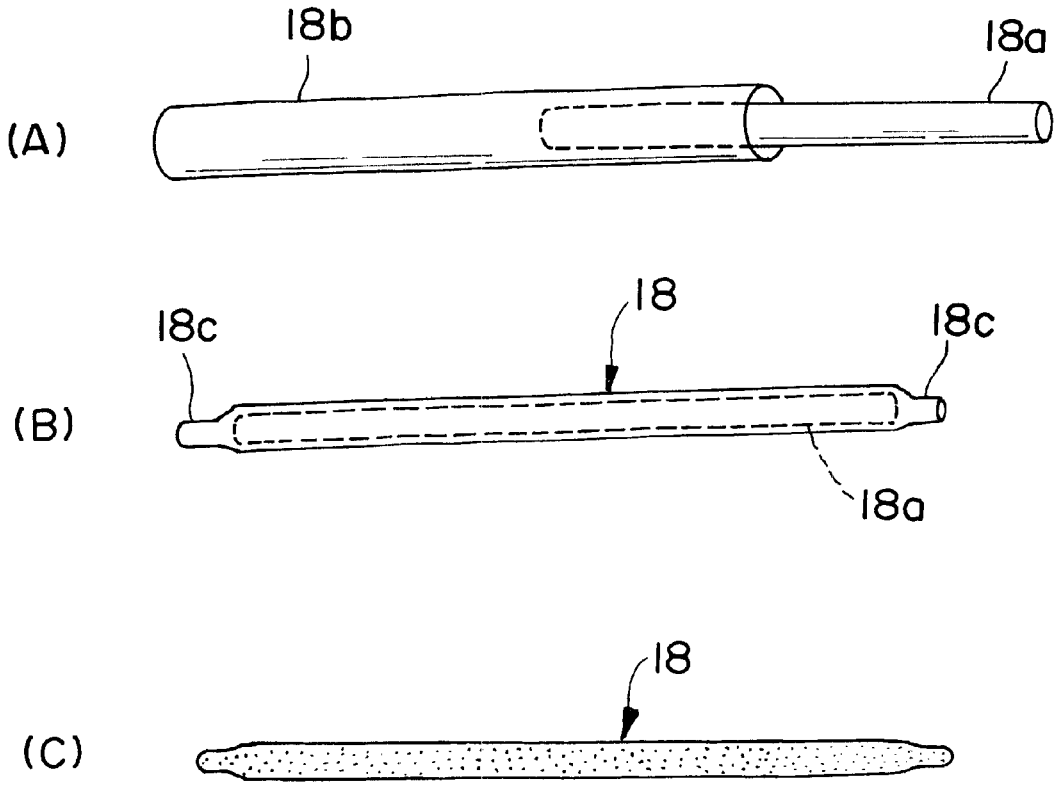
FIGS. 18(A)–(C) are perspective views showing the process for manufacturing the: rib of FIG. 17.

Next, several other examples of the wearer's own hair utilizing type wig using the rib 18 having a duplex construction as shown in FIG. 17 will be described.

Figure 19:
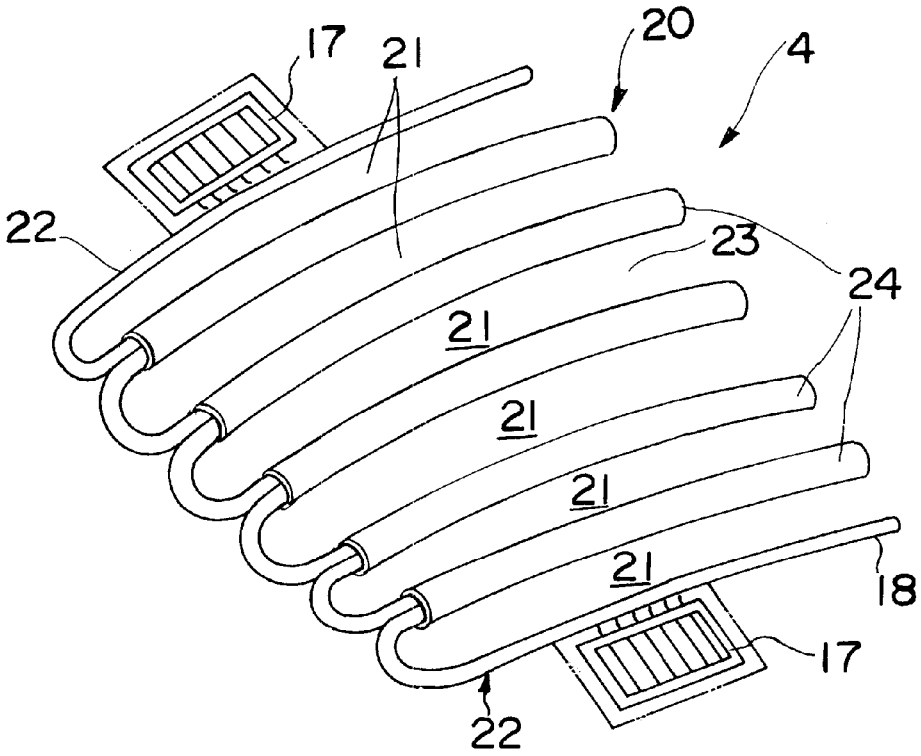
FIG. 19 is a perspective view showing a comb-like hair-secured frame of a wearer's own hair utilizing type wig according to a second embodiment of the present invention.

FIG. 19 is a perspective view of a wearer's own hair utilizing type wig according to a second embodiment of the present invention. Although the false hairs are omitted for the sake of clarity of the hair-secured frame 20, the false hairs are actually densely secured to the hair-secured frame 20 over its entire area such that the false hairs project outward from one side of the frame 20.

The wig shown in FIG. 19 can be inserted into the wearer's own hair like a comb at the time for attachment. For example, this wig is constituted as a comb-like hair-secured frame 20 by connecting six hair-secured frame units 21 parallel to each other. The hair-secured frame unit 21 comprises a U-shaped framework 22 and false hairs 15 densely attached to the framework 22 over its entire surface from one side thereof in such a manner as to project outward. The framework 22 is further provided at each opposite end thereof with a stopper 17 for securing the wig to the wearer's own hair.

Figure 20:
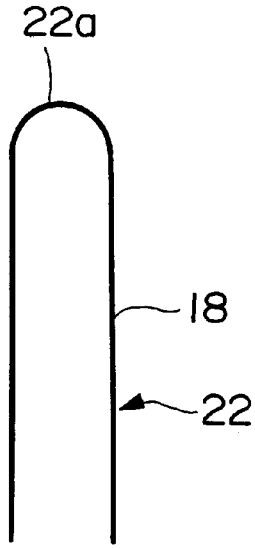
FIG. 20 is a top plan view showing a U-shaped framework used for the hair-secured frame according to the second embodiment.

As shown in FIG. 20, the framework 22 used in the hair-secured frame 20 uses a rib 18 which is bent in a U-shape. This U-shaped framework 22 is composed of a rib 18 and bent such that the respective distal ends of the rib 18 are arranged in parallel. This framework, unlike those of the first embodiment, etc., includes a framework composed of a rib. This U-shaped framework 22 is also curved in the lengthwise direction along the configuration of the wearer's head.

Referring back again to FIG. 19, the comb teeth-like hair-secured frame 20 is constituted by connecting the hair-secured frame units 21 parallel to each other. For connecting the U-shaped frameworks 22, as shown in FIG. 19, two U-shaped frameworks 22 are arranged in unison in a lengthwise direction and the mutually contacting two ribs 18 are covered with a connecting tube 24. By doing so, the adjacent two frameworks are connected together. By repeating the same procedure with respect to a desired set of frameworks 22 and attaching the false hairs thereto, there can be obtained a hair-secured frame 20 having a pattern which the wearer wants. This connecting tube 24 may use a thermally-contracting tube having a length corresponding to the length of its connected part. The false hairs 15 are also attached to the connecting tube 24.

For the attachment of this wearer's own hair utilizing type wig 4, it is not necessary to place the comb-like hair-secured frame 20 on the top of the wearer's head. It may simply be inserted into the hair in such a manner as to comb the hair along the scalp and simply blend with the wearer's own hair H. By doing so, a sufficient amount of the wearer's own hair can be pulled up by the action of the comb. Therefore, the wearer can easily attach the wig 4. Moreover, the wearer's own hair is fully blended with the false hairs, thereby enabling one to exhibit a free hairstyle.

Since this wearer's own hair utilizing type wig 4 is constituted only by the rib 8 as a skeleton as in the wig 1 shown in FIG. 1, perspiration and enhancement of hair generation from the wearer's scalp are, as a matter of course, not disturbed and provides excellent air permeability. Since the rib 18 can freely be formed in a curved shape along the configuration of the wearer's head, it fits nicely to the objective part of the wearer's head. Therefore, the wig 4 can be used without any feeling of disorder. In the case where the connected part of the framework 22 is covered with a rubber tube 24, there can be obtained a comfortable feel of wear without injury to the scalp.

Figure 22:
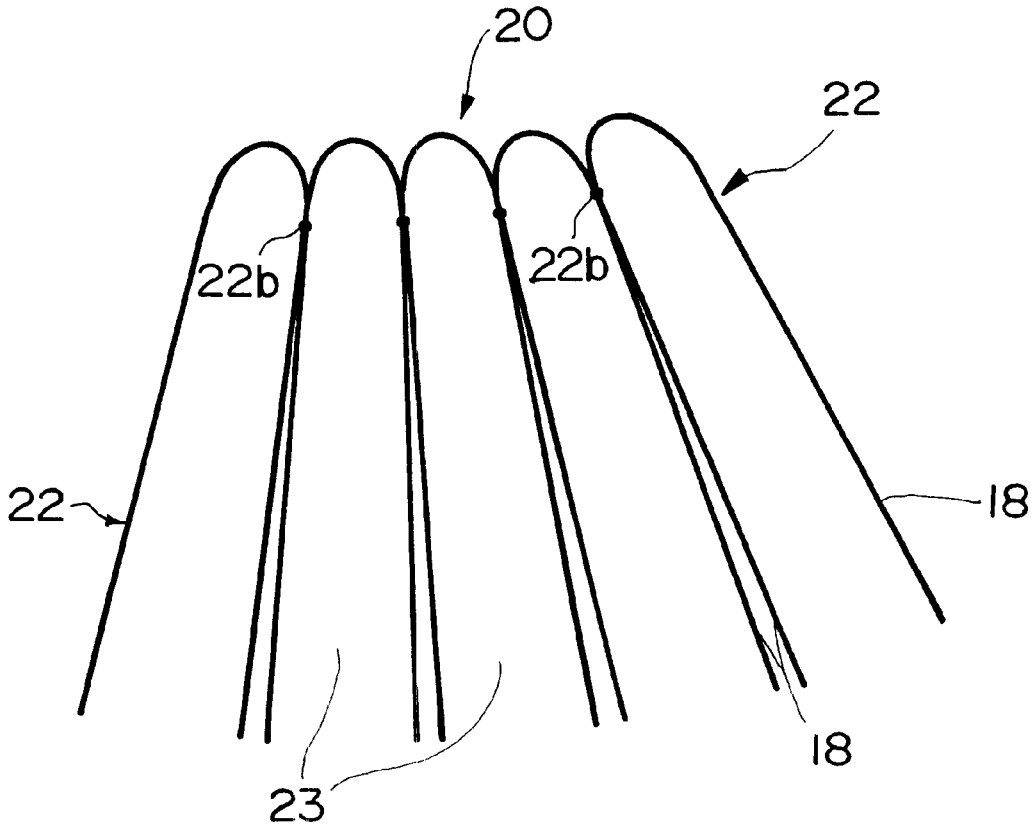
FIG. 22 is a perspective view showing another example of a constitution of the hair-secured frame according to the second embodiment.

It is also accepted that instead of connecting the respective U-shaped framework 22 of the hair-secured frame 20 through the connecting tube 24, the ribs 18 are, as shown in FIG. 22, knotted together at least at one contact point 22*b* and secured thereto by sewing or the like. As shown in FIG. 22, since the hair-secured frame 20 is formed by connecting the ribs 18 at one contact point 22*b* on their basal portion side, it can be spread or opened in a fan shape. By adjusting the opening angle of the hair-secured frame 20, the configuration of the frame 20 can freely be changed in accordance with the remaining hair of the wearer. Besides the above, a comb teeth-like hair-secured frame 20 having various different patterns can be formed by properly changing the part where the ribs 18 are fixed together.

Figure 21:
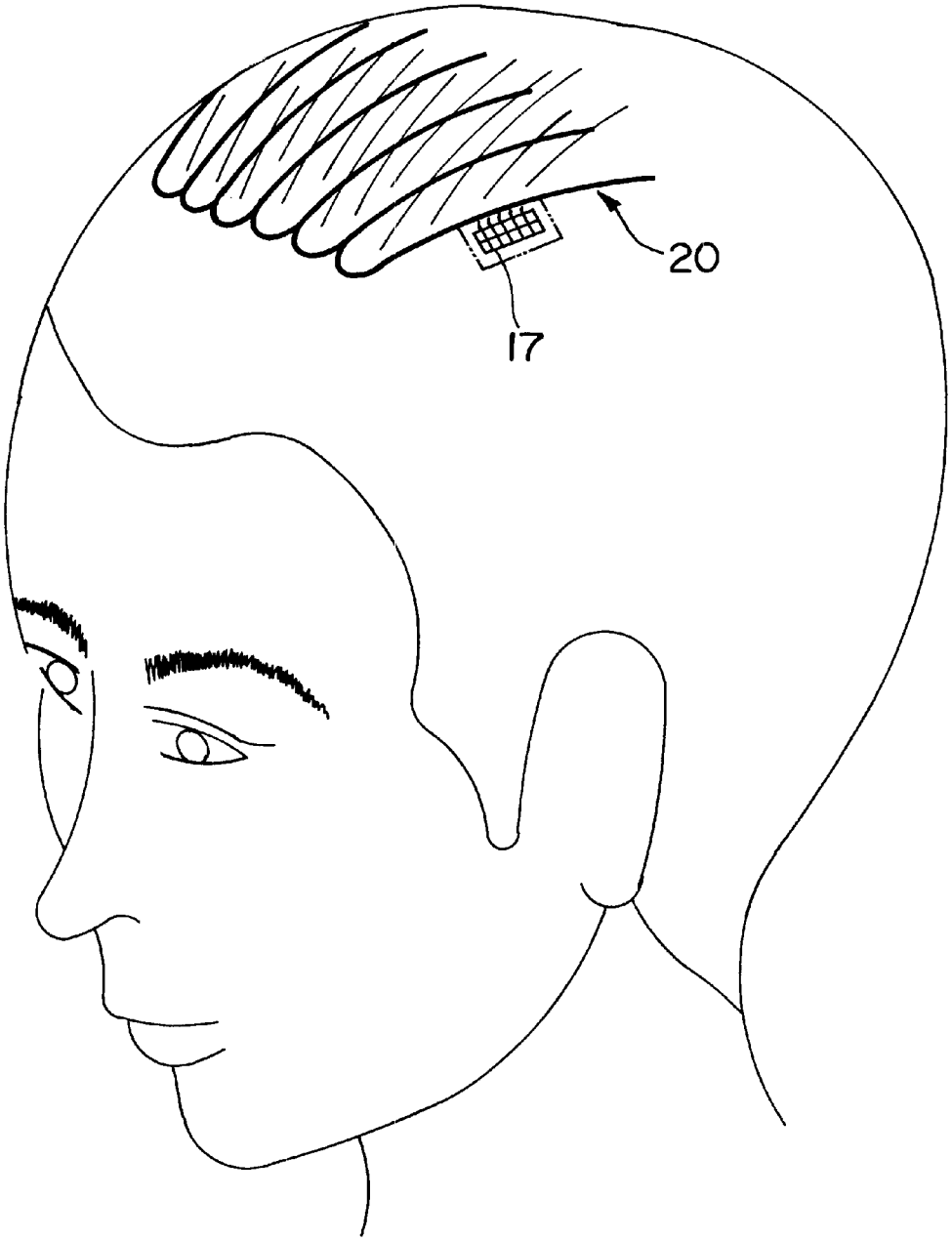
FIG. 21 is a perspective view showing a state a state in which the wearer's own hair utilizing type wig according to the second embodiment is attached to a wearer's head.

In the above description, as shown in FIGS. 19 and 21, the wearer's own hair utilizing type wig 4 is attached to the wearer's head such that the open end 23 of the hair-secured frame is located on the rear head portion. However, it is also accepted that the open end 23 is located, for example, on the forehead or lateral portion depending on the hairstyle. It is also accepted that the bending part 22*a* of the framework 22 is bent in a V-shape instead of U-shape.

Figure 23:
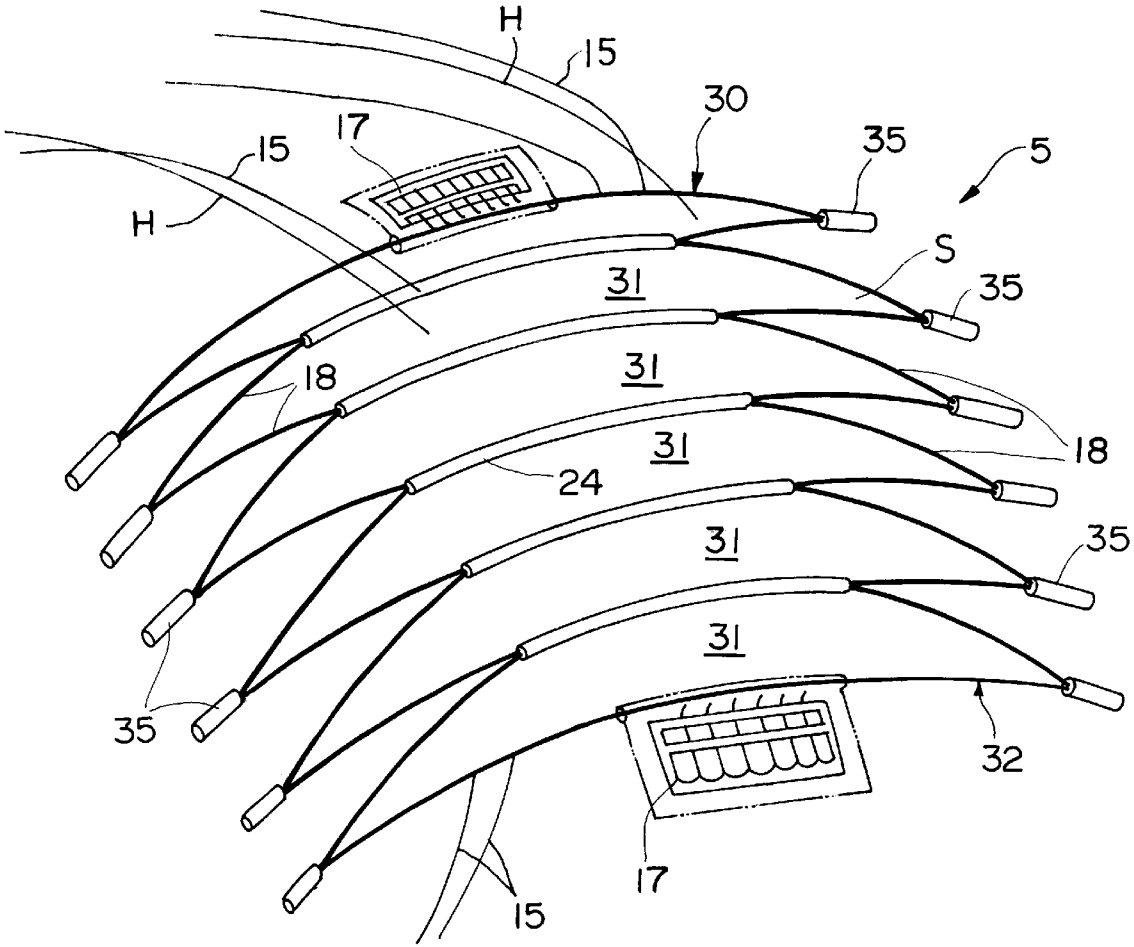
FIG. 23 is a perspective view showing a wearer's own hair utilizing type wig according to a third embodiment of the present invention.
Figure 24:
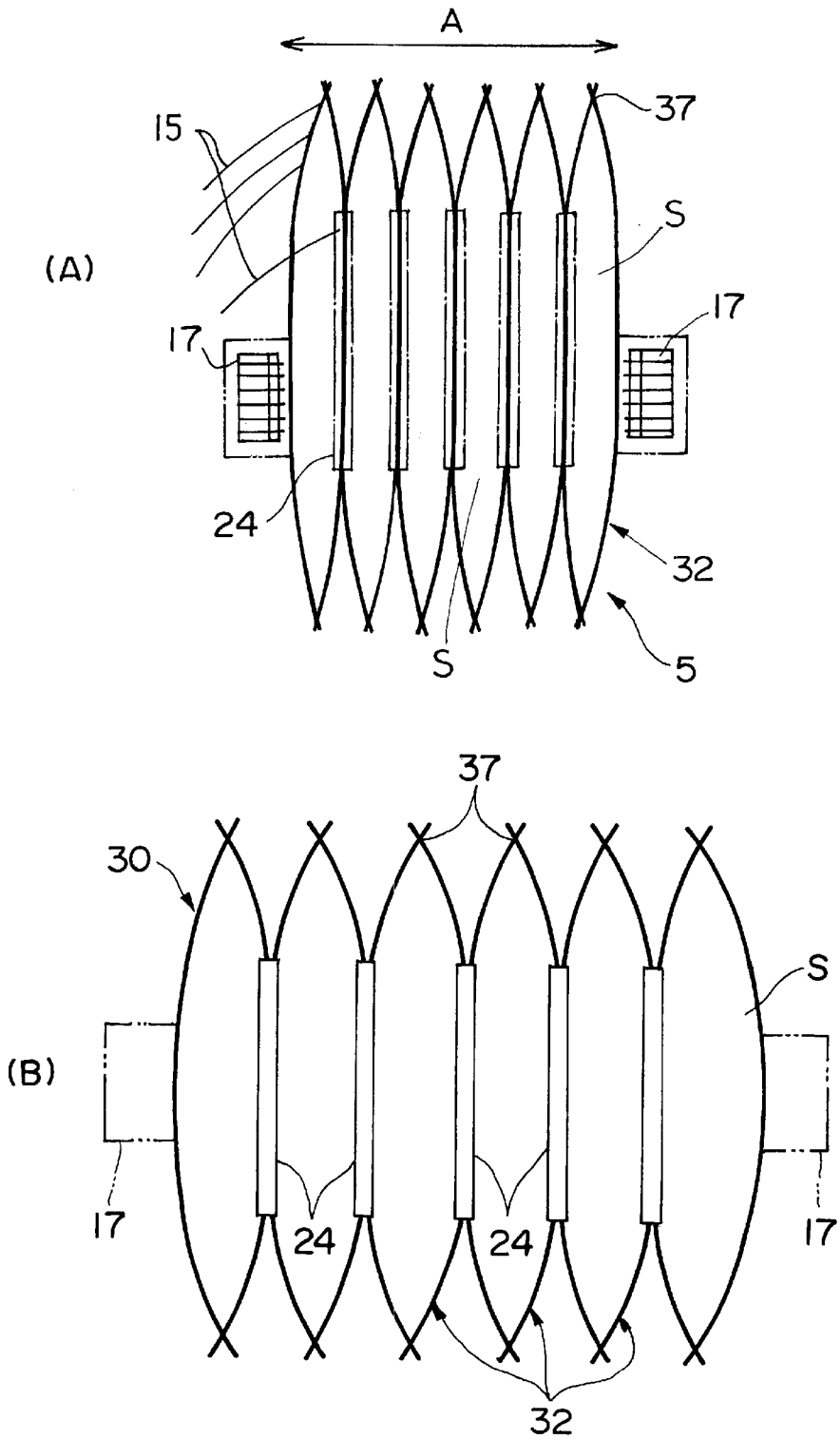
FIGS. 24(A) is a top plan view of a wearer's own hair utilizing type wig according to a third embodiment and FIG. 24(B) is a top plan view in which the wig is expanded from the state shown in FIG. 24(A)

FIGS. 23 and 24 are a perspective and a top plan view, respectively, of a wearer's own hair utilizing type wig 5 according to a third embodiment of the present invention. For attachment, this hair utilizing type wig 5 is, like the wig 1 shown in FIG. 1, placed on a desired part of the wearer's head and the false hairs 15 of the hair-secured frame 30 are blended with the wearer's own hair H. At the time of attachment, the hair-secured frame 30 is widthwise expanded to cause the annular spaces S to be come enlarged. Therefore, the wearer's own hair H can easily be pulled up through this enlarged space S and fully blended with the false hairs 15.

Since the component members or parts denoted by identical reference numerals used in the above description denote identical or similar component members or portions, detailed description thereof is omitted.

In FIG. 23, this hair utilizing type wig 5 is constituted as the hair-secured frame 30 of a pattern having large annular eyes arranged laterally by connecting, for example, six annular hair-secured frame units 31 parallel to each other. One pair of stoppers 17 is attached to the outermost side of the hair-secured frame units 31, 31 which are located at opposite sides such that the own hair H are nipped by the stoppers 17.

The hair-secured frame unit 31 comprises an annular framework 32 and the false hairs 15 densely attached to the framework 32 over an entire area thereof such that the false hairs 15 project outward from one side of the framework 32. In this embodiment, the annular frame work 32 is formed by connecting opposite ends of two curved ribs 18 through a connecting member 35 composed of an elastic tube or cap or the like, to form a pattern in an annular shape, having in the illustrated example, leaf-like large eyes arranged laterally, parallel to each other. As apparent from the illustration, it has a canoe-like contour and a curved shape and is formed in an elliptical shape having sharpened front and rear ends.

Figure 25:
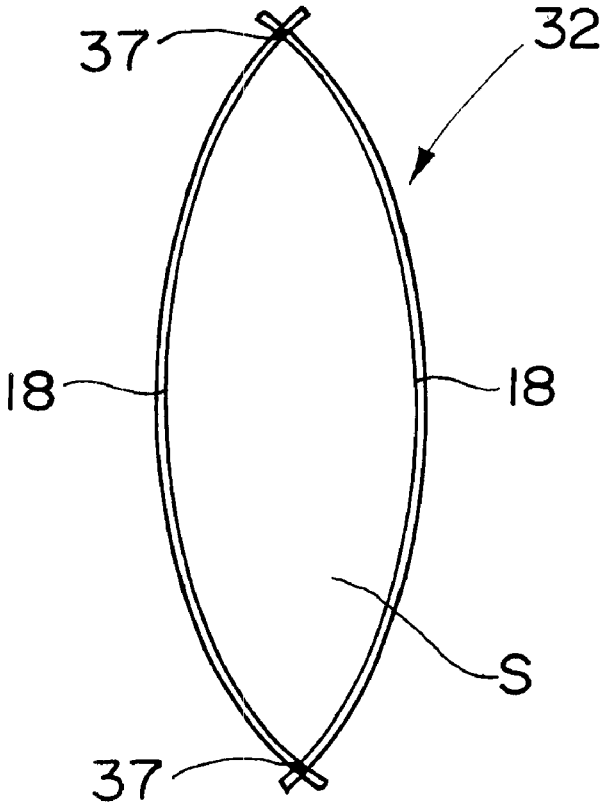
FIG. 25 is a top plan view showing an annular framework used for the wearer's own hair utilizing type wig according to the third embodiment.

The annular framework 32 is constituted by connecting the two curved ribs 18 in such a manner as to form an annular shape (see FIG. 25), the two ribs 18, 18 having a contour of a gently curved shape in one direction along the wearer's head configuration. Owing to this arrangement, a comparatively large opening S (in the illustrated example, a space having a leaf-like contour) enabling to insert the wearer's own hair H therethrough is formed between the ribs 18, 18.

Figure 26:
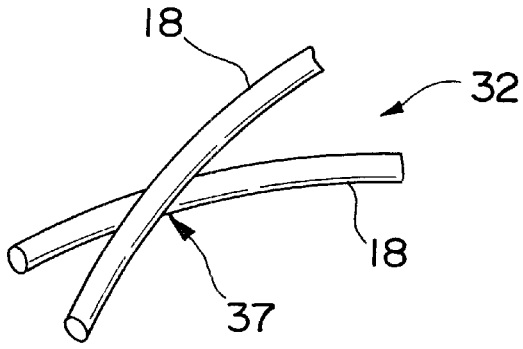
FIG. 26 is a perspective view showing a constitution of two ribs connected at distal end portions thereof, of the annular framework of FIG. 25.

A crossing point 37 of fine wire rods composing the annular framework 32 is formed by crossing and connecting the distal ends of the wire rods as shown in FIG. 26. Owing to this arrangement, the wearer's own hair can enter between the two ribs 18, 18 which are branched outward from the crossing point 37, and therefore, the entangling amount of the false hairs with the wearer's own hair is greatly increased. This makes it difficult for the hair-secured frame 30 to be noticed.

Figure 27:
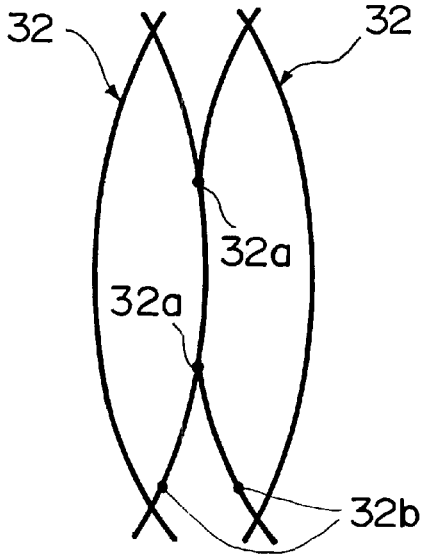
FIG. 27 is a top plan view showing a connecting constitution of the adjacent annular frameworks of the wearer's own hair utilizing type wig according to the third embodiment of the present invention.

In the case where the hair-secured frameworks 31 are connected together in parallel, as shown in FIG. 23, the two ribs 18, which contact each other, are sequentially inserted into the connecting tubes 24. It is also accepted that instead of the connecting tube 24, the ribs 18 are connected, for example, at two contact points between the annular frameworks 32, 32 as shown in FIG. 27 by tightly binding the ribs 18 with a nylon string or the like. In the alternative, the ribs 18 may be adhered to each other at any other appropriate points. In the case where the ribs 18 are sequentially connected together at one point of the basal end parts of the annular framework 32 by means of adhesion, sewing or the like, there can be obtained a hair-secured frame having a pattern which is opened in a fan shape.

Operation of the hair utilizing type wig 5 thus constructed will now be described.

Since each annular framework 32 is composed of ribs 18 having rigidity and elasticity, the framework 32 is expanded in a widthwise direction. At the same time, the framework 32 is contracted in the lengthwise direction. Therefore, when the annular framework 32 is pulled in a widthwise direction, the entire hair utilizing type wig 5 is expanded in the direction as indicated by the arrow A of FIG. 24(A) and the width between the two ribs 18 of each annular framework 32 is enlarged, thereby enlarging the opening S as shown in FIG. 24(B).

Figure 28:
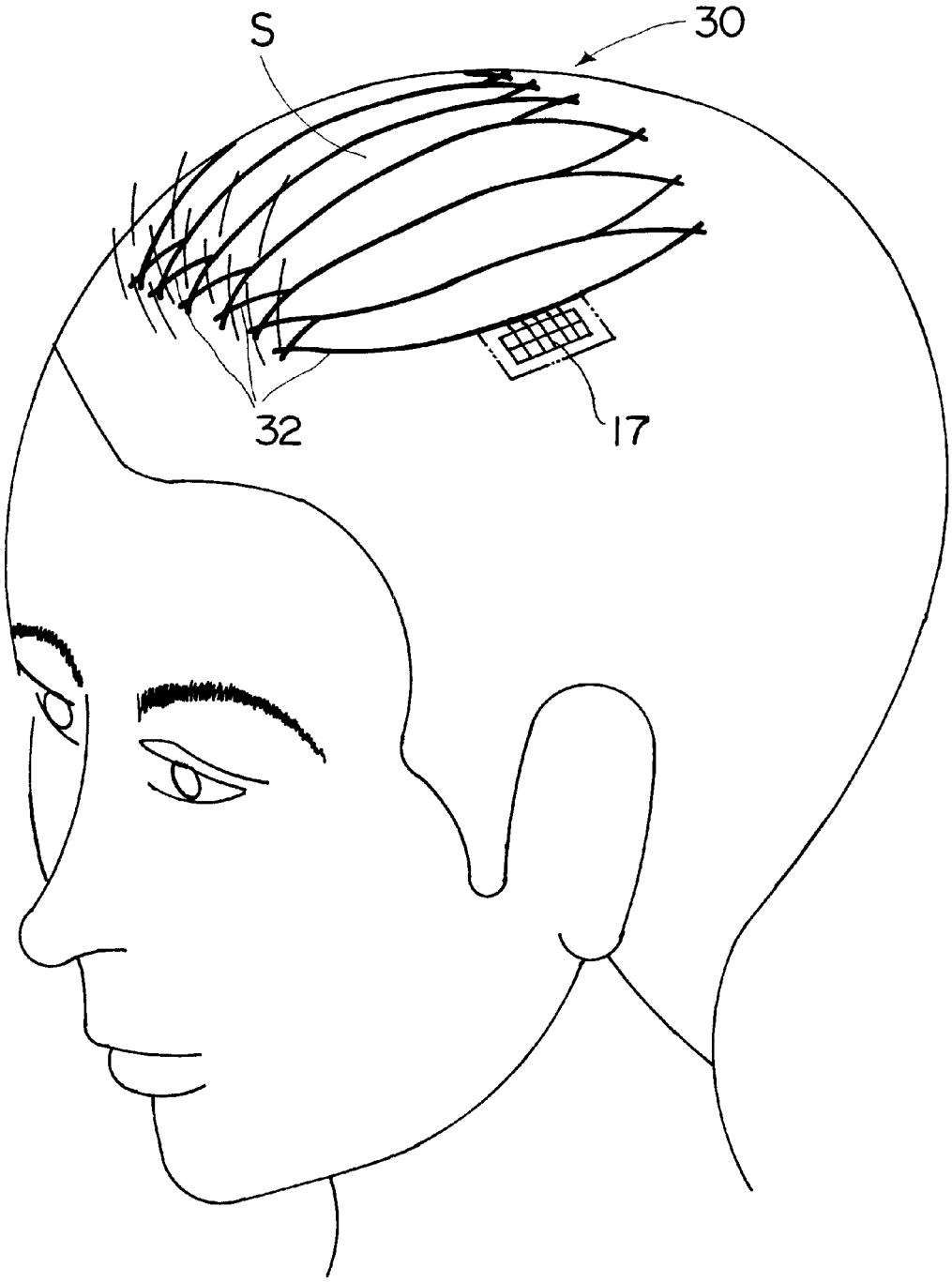
FIG. 28 is a perspective view showing a state in which the wearer's own hair utilizing type wig according to the third embodiment of the present invention is attached to the wearer's head.

The sequential steps for attaching the wearer's own hair utilizing wig 5 having the hair-secured frame 30 will now be described. First, as shown in FIG. 28, the wearer places the wearer's own hair utilizing type wig 5 on the head at a location offset, for example, a few centimeters from the hairline at the forehead portion towards the rear head portion and correctly positioned. Then, the hair-secured frame 30 is pulled in the direction (widthwise direction) as indicated by the arrow A of FIG. 24(A) until the opening S reaches it's predetermined size. Then, the wearer brings the stopper 17 into engagement with his or her own hair H. Then, the wig 5 is fixed to the head in the state in which the openings S of the annular framework 32 constituting the hair-secured frame 30 are further expanded (see FIG. 24(B)).

Since the wearer's own hair H is still depressed by the underside of the hair-secured frame 30, the wearer inserts the tip of a comb or brush into the opening S towards the scalp and then, pulls up and out the wearer's own hair H outward through the opening S by catching the hair H with the comb or brush. Then, most of the wearer's own hair S with the exception of that pressed by the hair-secured frame 30 is pulled out. The wearer's own hair H is also pulled up through serrated spaces at the front and rear ends of the hair-secured frame 30. The large amount of pulled-out wearer's own hair is blended with the false hairs 15 of the hair-secured frame by brushing to form a desired look. By doing so, the attaching operation of the wearer's own hair utilizing type wig is completed.

When the wearer's own hair utilizing type wig is attached in the manner as mentioned above, the wearer's own hair H pulled out through the recessed parts having the serrated configuration of the hair-secured frame 30 conceals:the hair-secured frame 30 itself and the false hairs 15 attached to the projecting distal end of the annular framework 32 are blended with the wearer's own hair to cover up the distal end. Therefore, the fact of wearing a wig is not detectable.

Consequently, in the wearer's own hair utilizing type wig 5 of this embodiment, since a large amount of the wearer's own hair is pulled up through the opening S of the annular framework 32 and evenly blended with the false hairs 15, the separation of the wearer's own hair from the false hairs as is experienced with the conventional wig can be restrained. Thus, the fact of the wearer's wearing a wig is difficult to be visually recognized. In addition, a desired hairstyle can be maintained for a long period of time.

Moreover, since the hair-secured frame 30 is notched at acute angles from the protruded end section of the forehead portion towards the retracted portion particularly on the front end side, the peripheral edge of the hair-secured frame 30 does not appear as a line in the traversing direction and there is no risk that the fact of wearing a wig is visually recognized.

With the conventional wig, the wig base is fixed to have a predetermined form and the stopper is fixed in a designated place which cannot be moved. In contrast, in this hair utilizing type wig, the hair-secured frame 30 is able to be expanded to some extent and therefore, the engagement position between the stopper and the wearer's own hair can be adjusted with ease. This serves to reduce the weight incurred by the scalp and the wearer's own hair.

Incidentally, the rib 18 may also be applied to a wig having a peripheral edge frame. Several wigs of that type will be described hereinafter.

Figure 29:
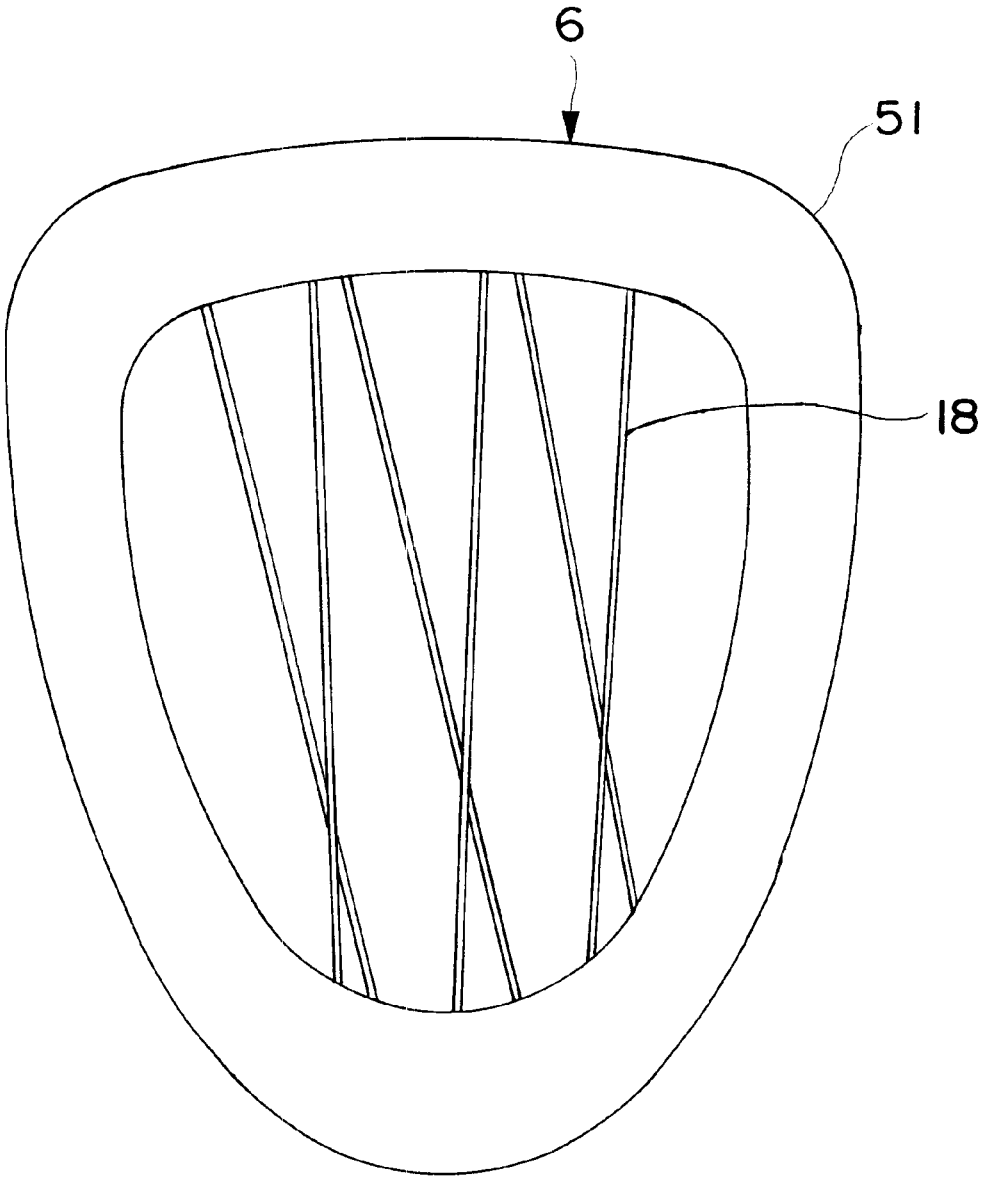
FIG. 29 is a schematic top plan view showing a constitution of another embodiment of a wearer's own hair utilizing type wig according to the present invention, in which false hairs are omitted.

FIG. 29 is a schematic plan view of a wearer's own hair utilizing type wig 6 according to another embodiment of the present invention, in which the implanted hairs are omitted. In FIG. 29, the upper side of the hair utilizing type wig 6 corresponds to the forehead portion and the lower side corresponds to the rear head portion. This wig 6 is designed as a partial wig which is formed in such configuration and size that it can, as a whole, cover a thin hair portion of the wearer's head. This wig 6 includes a wig base formed by arranging a plurality of rib 18 in a vertical direction (forward and backward direction of the wearer's head) within the peripheral edge framed member 51. As shown in FIG. 29, the first rib 18 is crossed at its rear head portion with a second rib 18 within the inner peripheral region of the peripheral edge framed member 51 and attached to the peripheral edge framed member 51. At the crossing point, the ribs 18 are able to move freely irrespective of the counterpart rib 18 without being connected together.

Figure 30:
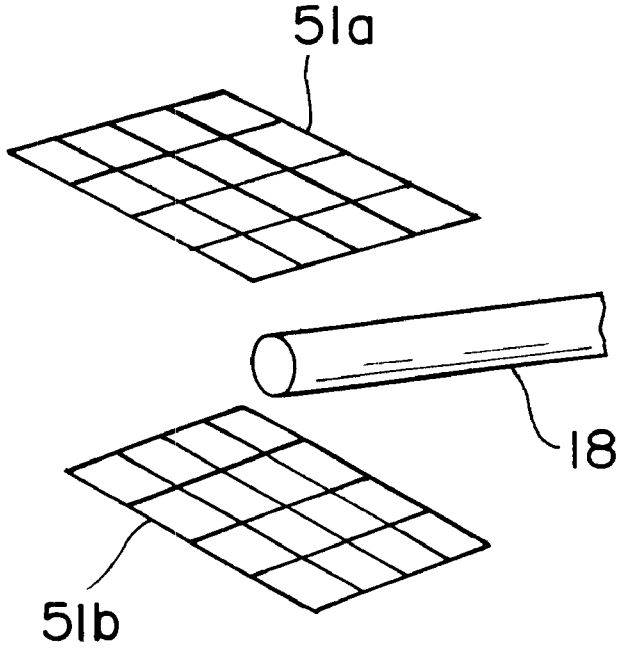
FIG. 30 is a perspective view for explaining the attachment of the rib to a peripheral framed member in the embodiment shown in FIG. 29.

As shown in FIG. 30, a rib 18 is sandwiched between two net members 51*a*, 51*b* composing a peripheral edge framed member. By attaching false hairs 15 to the upper and lower net members 51*a*, 51*b* with the rib 18 sandwiched therebetween, the rib 18 is attached to the peripheral edge framed member 51 securely. The number of ribs 18 attached to the peripheral edge framed member 51 can properly be increased or degreased depending on the density of the wearer's own hair.

According to this wig 6, even if the ribs 18 are pulled at the time of pulling up the wearer's own hair between the ribs 18, the hairstyle can easily be adjusted without damaging the wearer's own hair and scalp because the ribs 18 are designed to return to their original shape by their own rigidity and elasticity. Also the wig is in excellent shape retainability because the ribs 18 are fixed to the peripheral edge framed member 51. Moreover, the wearer's own hair pulled up and out between the ribs 18 are easily maintained in the pulled-out state because the ribs 18 are crossed by each other and the wearer's own hair is properly tightened at the crossing points.

Figure 31:
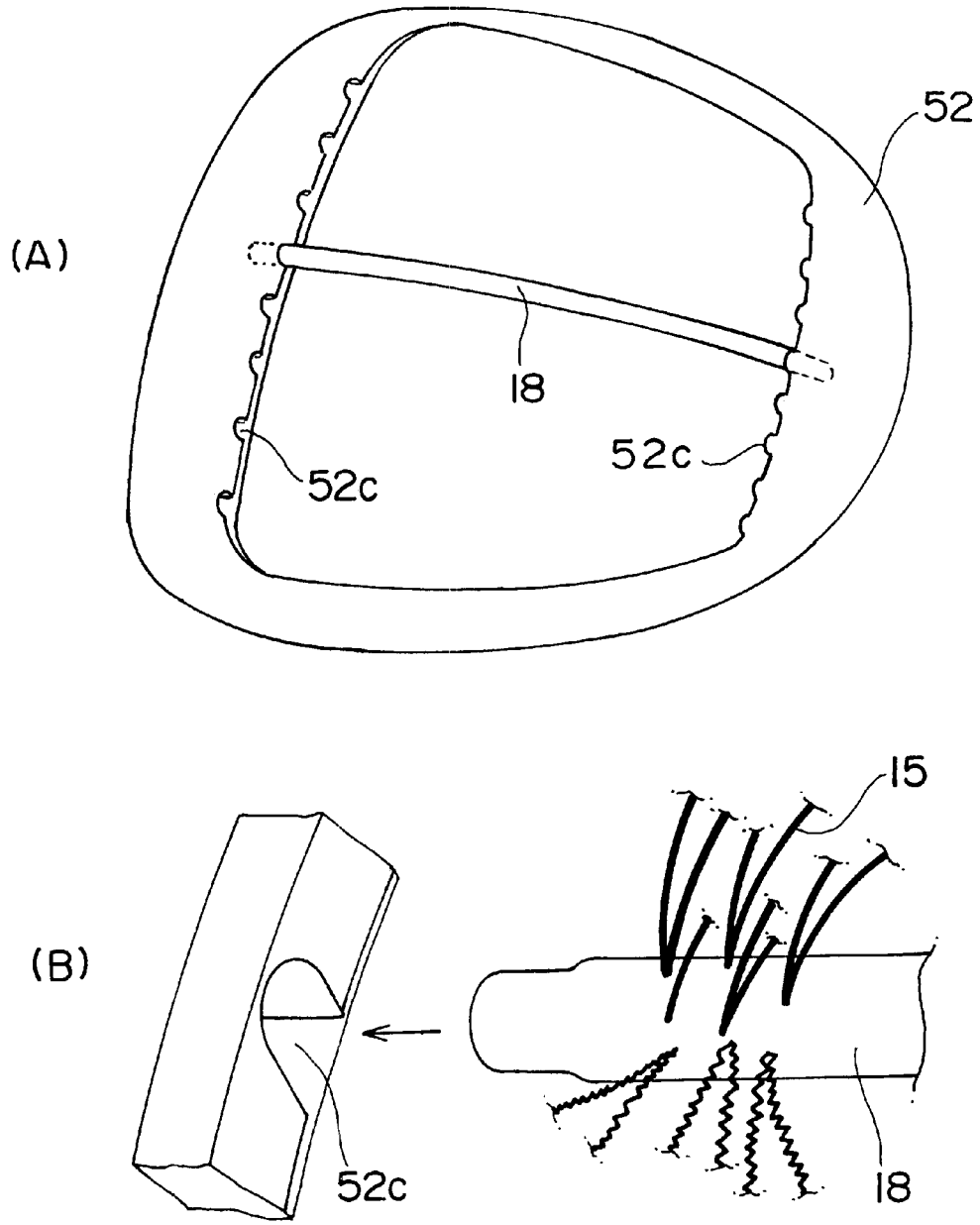
FIG. 31(A) is a perspective view showing one example of a constitution of a peripheral framed member in a wearer's own hair utilizing type wig according to a further embodiment of the present invention and FIG. 31(B) is a partly enlarged perspective view showing an inlet opening for attaching a rib to an inner end edge of the peripheral framed member of FIG. 31(A)

FIG. 31 shows a construction of an wearer's own hair utilizing type wig in which a rib 18 can be detached from a peripheral edge framed member 52. This peripheral edge framed member 52 has, as shown in FIG. 31(A), holes 52*c* for inserting the rib 18 therein, of which these holes 52*c* are formed, for example, at an inner peripheral edge thereof corresponding to the forehead portion or rear head portion. As shown in FIG. 31(B), opposite ends of the rib 18 are inserted and fixed in the holes 52*c*. Use of such a peripheral edge framed member 52 makes it possible to attach a rib 18 to a peripheral edge framed member 52 freely in accordance with the extending direction of the wearer's own hair and be placed exactly where the hair should be increased in number. Thus, the hair can be increased in number properly in such a manner as to balance the distributed state of the wearer's thin hair.

Figure 32:
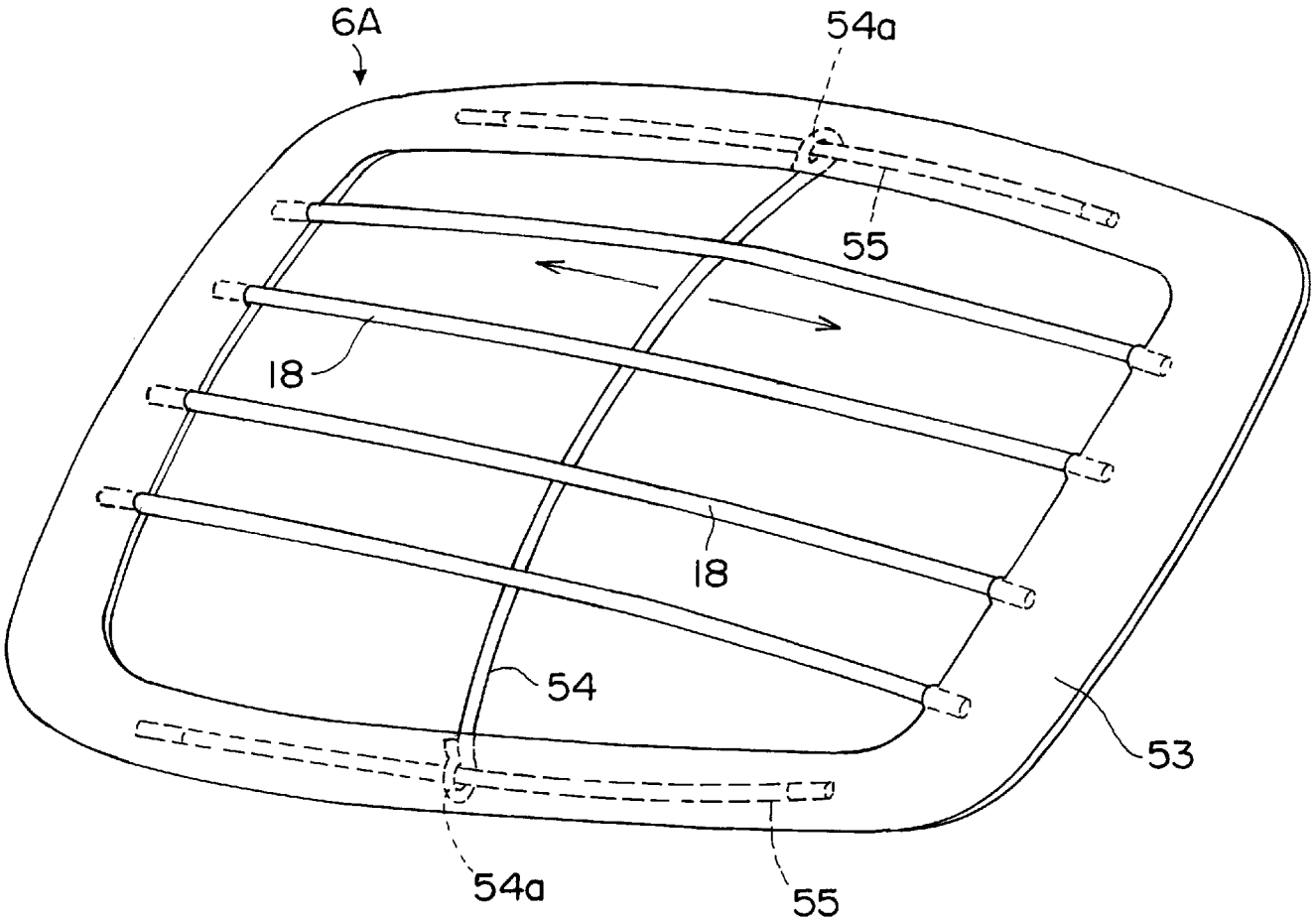
FIG. 32 is a perspective view of a wig base equipped with an auxiliary member in the wearer's own hair utilizing type wig of FIG. 31.

A further embodiment of the present invention will be described with reference to FIG. 32. This wig includes ribs 18 which can be detached from a peripheral edge framed member 52 as described with reference to FIG. 31. The wig further includes slide ribs 54, as auxiliary members, which are crossed, at right angles, with the ribs 18. Similar parts of the above embodiments are denoted by similar reference numerals and description thereof are omitted. The false hairs attached to the wig 6A are omitted in the illustration for the sake of clarity.

A pair of guide ribs 55 is disposed in the same direction, i.e. a front to back direction of the wig, as well as the ribs 18 set parallel to each other at an even distance along the peripheral edge framed member 52 on its inner surface side which contacts the scalp. The pair of guide ribs 55 are connected to the peripheral edge framed member 53 at opposite ends thereof. Loops 54*a*, 54*b* formed at opposite ends of the slide rib 54 are passed through the guide ribs 55 so that the slide rib 54 can in fact slide back and forth along the guide ribs 55. The slide rib 54 and the guide ribs 55 which support the slide rib 54 may be formed in a duplex construction from the same material as the ribs 18 themselves.

By additionally employing the auxiliary members composed of the slide rib 54 and the guide ribs 55, the slide rib 54 can be slid to a position where the hair increasing effect is to be enhanced. Then, by adding the wearer's own hair pulled up and out between the ribs 18 on the slide rib 54, the previously compressed wearer's own hair can be pulled up again restrained and the outwardly extended state of the wearer's own hair can be maintained. Thus, the hair increasing effect can be visually enhanced.

Two slide ribs 54 may be disposed in the traversing direction. Moreover, the rib 18 itself may be used as the guide rib 55. For example, it can also be accepted that the ribs 18 arranged at the opposite left and right ends are used as the guide members and the slide rib 54 is disposed across the guide members.

Although a partial wig has been described in the above embodiments, the ribs 18 may likewise be applied to a full wig. The expression "full wig" refers to a wig which is formed in a cap shape from the forehead portion to the rear head portion generally along the entire hairline.

Figure 33:
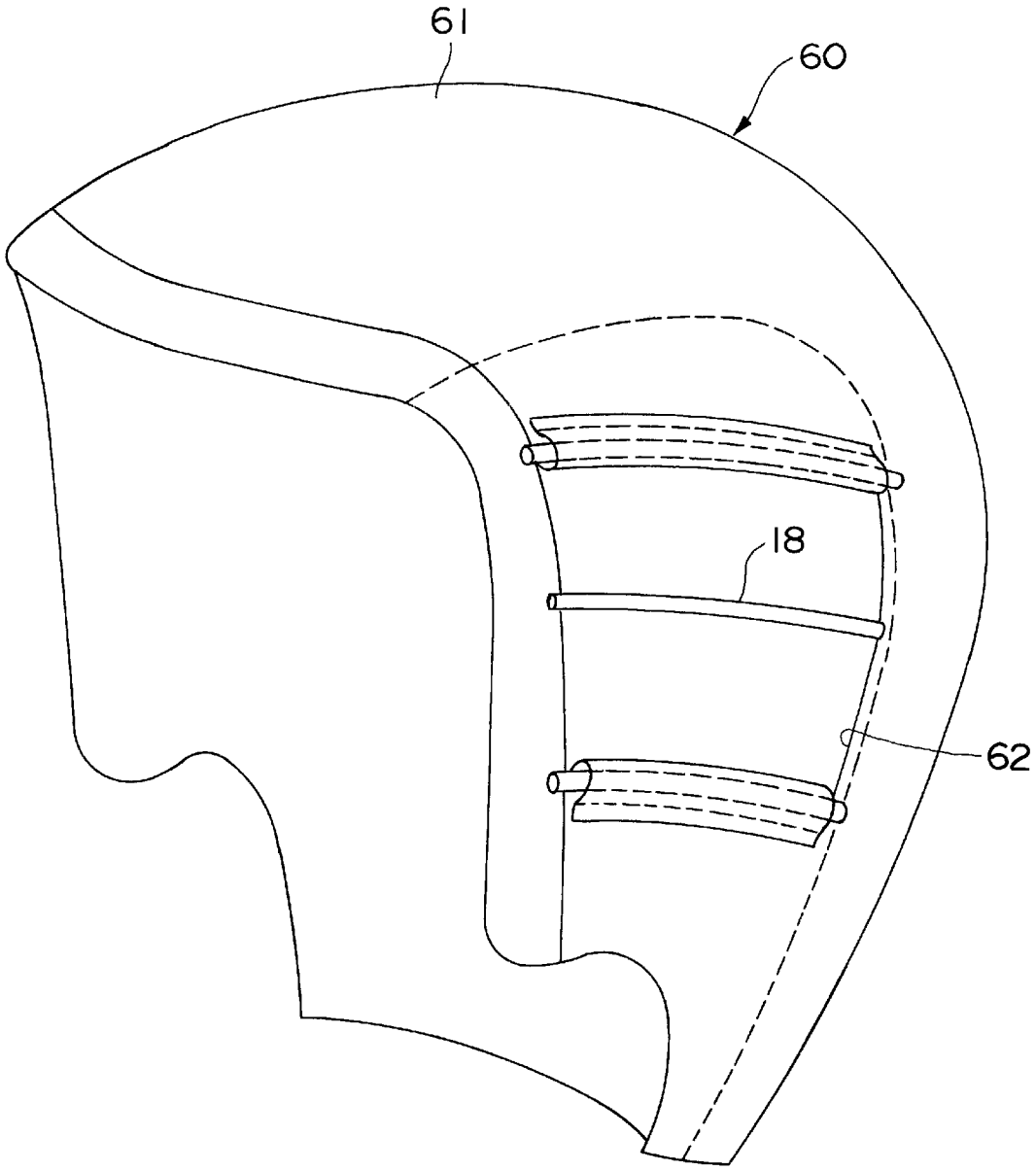
FIG. 33 is a schematic perspective view showing one example in which the rib according to the present invention is applied to a full wig.

FIG. 33 is a schematic perspective view showing a wig base 61 of a full wig 60. The wig base 61 includes a cutaway section 62 which is formed by partly cutting away a net (or artificial skin) at a location corresponding to the left side of the head. Ribs 18 are arranged at intervals in this cutaway section 62. The location, size, shape, number or the like of the cutaway section 62 may be altered in many ways depending on the density of the wearer's own hair, perspiration factor or the like. A proper number of ribs 18 are disposed along the hair flow direction of the wearer's own hair and attached to the cutaway section 62 along the curved configuration of the head.

Figure 34:
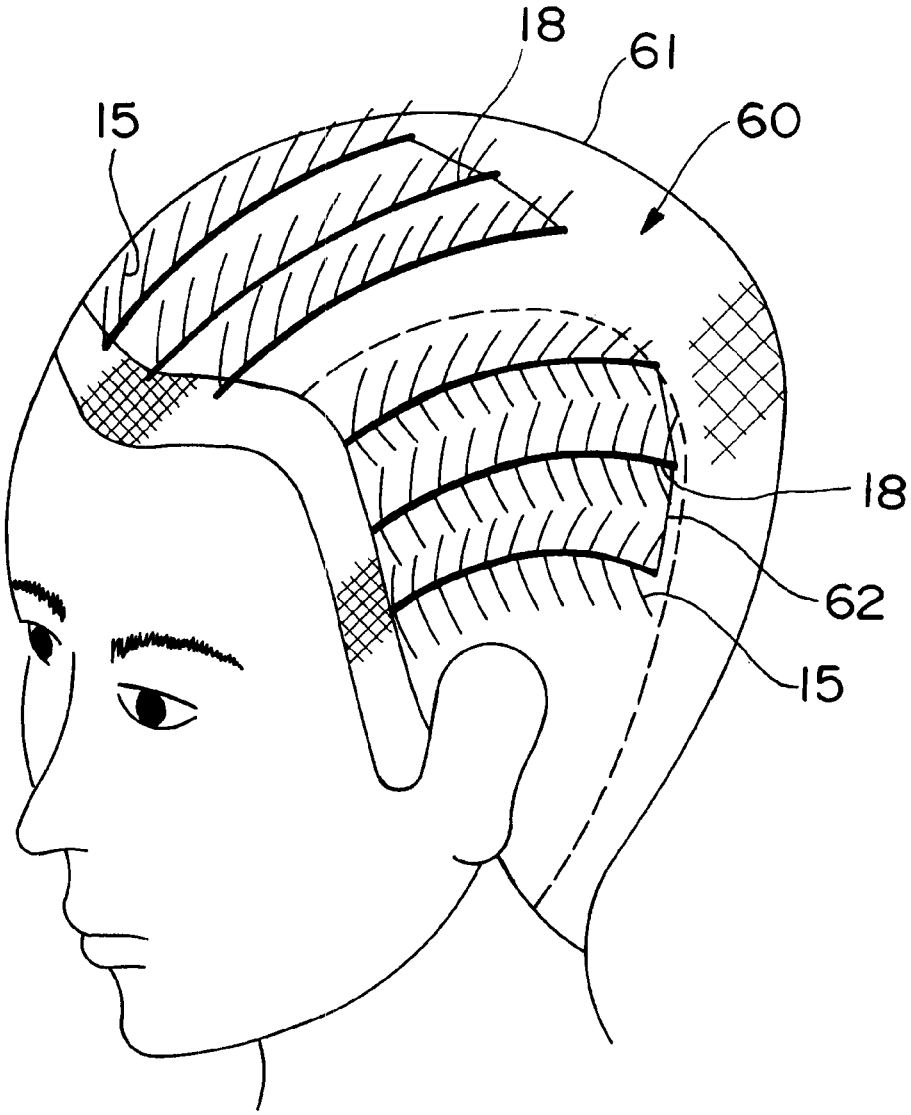
FIG. 34 is a perspective view showing a state in which the full wig of FIG. 33 is attached to a wearer's head.
Figure 35:
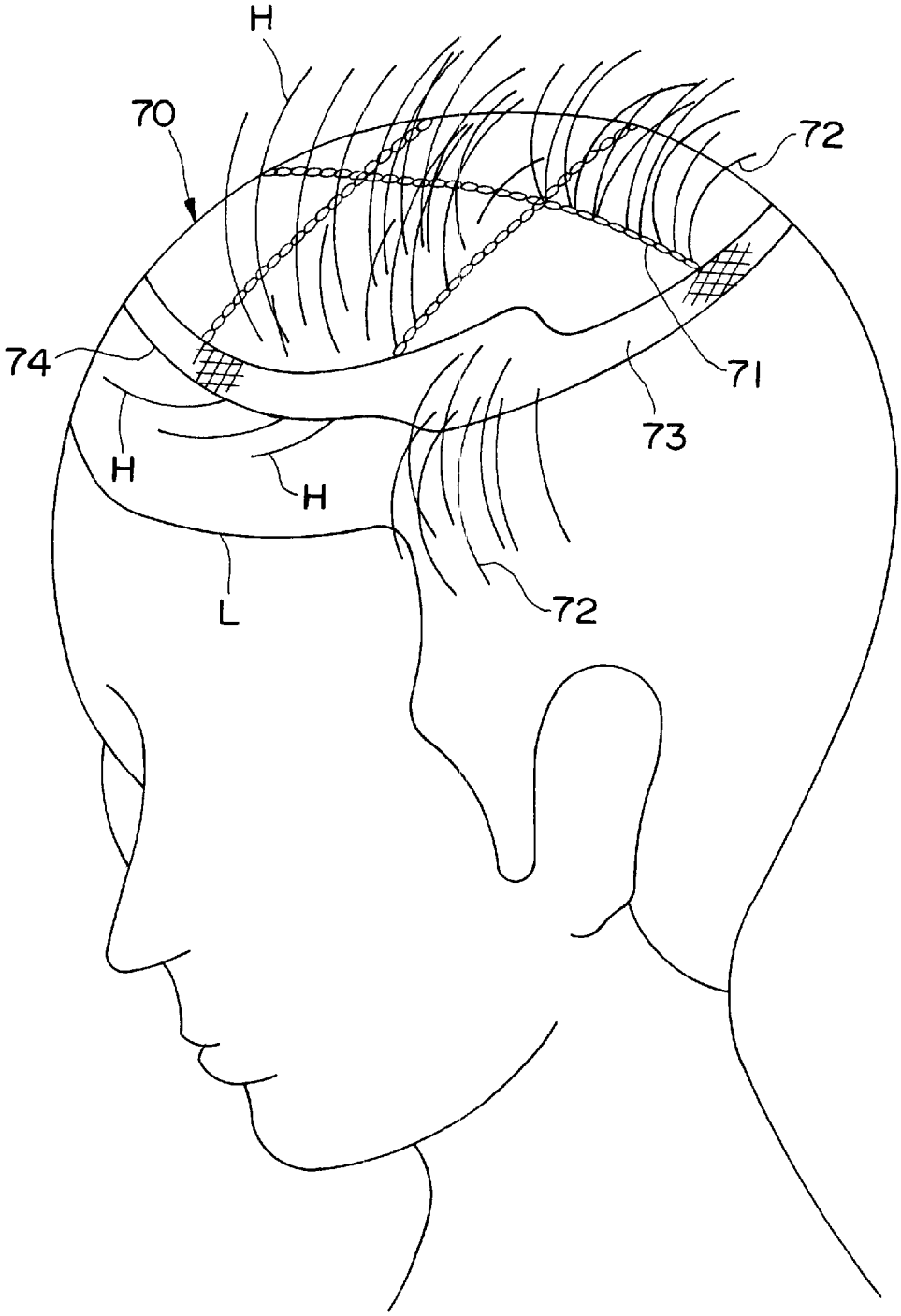
FIG. 35 is a perspective view showing a state in which the conventional wearer's own hair utilizing type wig is attached to wearer's head.

FIG. 34 is a perspective view showing a state in which the full wig 60 is attached to the wearer's head. This full wig 60 is designed in such a way that the wearer's own hair is pulled up through cutaway section 62 formed at the top and the left sections of the head. In FIG. 34, the false hairs 15 attached to the wig base 61 are schematically shown and the wearer's own hair pulled up through the cutaway section 62 is omitted.

In this full wig 60, the wearer's own hair can easily be pulled up through the cutaway section and can be easily blended with the false hairs on the wig. Moreover, because the ribs 18 themselves are composed of a rigid material and have elasticity, the ribs 18 can instantly be restored to it's original shape even if the ribs 18 themselves are deformed when the wearer's own hair and false hairs 15 are pulled at the time for combing the hair. Thus, a hairstyle can easily be rearranged.

It should be noted that the present invention is not limited to the above embodiments, many changes and modifications can be made without departing from the gist of the present invention and those changes and modifications are not excluded from the scope of the invention.

INDUSTRIAL APPLICABILITY

According to the present invention, there can be obtained a wearer's own hair utilizing type wig in which the wearer's own hair can easily be pulled up and outside the wig, and the amount of hair, as a whole, can be made abundant by evenly and effectively utilizing the wearer's own hair. Moreover, in the case where a framework is formed in a skeleton shape using a rib having rigidity and elasticity, a peripheral edge frame for the wig is no longer required. Thus, there can be provided a wearer's own hair utilizing type wig in which the perimeter of the wig is not easily recognized.

What is claimed is:

1. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework being constituted by a single rib curved or bent in such a manner as not to form an outline of said wig, for attachment, the wearer's own hair being pulled up through a space of said hair-secured frame and blended with the false hairs attached to said skeleton-like framework.

2. A wearer's own hair utilizing type wig according to claim 1, wherein the single rib is made of a fine wire rod.

3. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including a plurality of ribs and at least one connecting rib crossing for conection with each of said plurality of ribs at least at one point in such a manner as not to form an outline of said wig, wherein the plurality of ribs and the at least one connecting rib are each made of a fine wire rod.

4. A wearer's own hair utilizing type wig according to claim 3, wherein said skeleton-like framework includes a plurality of ribs arranged in parallel to each other and an annular connecting rib crossing for connection with each of said plurality of ribs at two points such that the end portions of said ribs project outward, the false hairs being attached to both said plurality of ribs and said annular connecting rib.

5. A wearer's own hair utilizing type wig according to claim 3, wherein the plurality of ribs and the at least one connecting rib are all composed of the same fine wire rod.

6. A wearer's own hair utilizing type wig according to claim 3 wherein said plurality of ribs extend forward and/or backward in correspondence with at least a forehead portion and/or a rear head portion of the wearer's head.

7. A wearer's own hair utilizing type wig according to any one of claims 3 and 6, wherein said plurality of ribs are combined for connection with each other so as to conform to the wearer's hairstyle.

8. A wearer's own hair utilizing type wig according to any one of claims 3 and 6, wherein adjacent ribs among said plurality of ribs arranged parallel to each other are combined at a larger interval in a given peripheral area of a hair-dividing part than the predetermined intervals between the adjacent remaining ribs.

9. A wearer's own hair utilizing type wig according to any one of claims 3 and 6, wherein said plurality of ribs extends in general, parallel to each other, each of said ribs being bent away from a contour of the wearer's head at a lengthwise intermediate part thereof and curved from the bent part towards a distal end along a contour of the wearer's head such that a distal end thereof contacts the scalp of the wearer.

10. A wearer's own hair utilizing type wig according to any one of claims 3 to 6, wherein said plurality of ribs are combined proximate to each other with a reduced space between adjacent ribs, at that are of said skeleton-like framework where a major hair-increasing density is required.

11. A wearer's own hair utilizing type wig according to any one of claims 3 to 6, wherein a hair-implanted section made of a net member or an artificial skin is stretched between said adjacent ribs.

12. A wearer's own hair utilizing type wig according to claim 11, wherein the false hairs are attached to the hair-implanted section for forming hair dividing part.

13. A wearer's own hair utilizing type wig according to any one of claims 1, 3 or 6, wherein each of said ribs is composed of an elastic core material which is made of a rigid material and a thermally-contractible tube covering the core material.

14. A wearer's own hair utilizing type wig according to any one of claims 1, 3 or 6, wherein each of said ribs includes a false hair attachment loop at a free end thereof.

15. A wearer's own hair utilizing type wig according to any one of claims 1, 3 or 6, wherein each of said ribs has a swollen part at a free end thereof.

16. A wearer's own hair utilizing type wig in which type wig in which for attachment, the wearer's own hair is pulled up through a space in the wig and blended with false hair attachment to said wig, said wig comprising:

a hair-secured frame including a plurality of U- or V-shaped hair-secured frame units having no perimeter and arranged parallel to each other such that said hair-secured frame exhibits a combo-like configuration as a whole, each of said U- or V-shaped hair-secured frame units including a skeleton-like framework and a plurality of false hairs attached to said skeleton-like framework, said skeleton-like framework being constituted by at least one rib made of a fine rod, said skeleton-like framework including a rib bent into a U- or V-shape, for attachment, said comb-like hair-secured frame being inserted towards the wearer's head portion first with a free end side thereof and the wearer's own hair is blended with the false hairs.

17. A wearer's own hair utilizing type wig according to claim 16, wherein said plurality of U- or V-shaped hair-secured frame units are connected together at basal portions thereof, thereby forming, as a whole, a comb-like hair-secured frame which is widened in a fan-shaped, for attachment, said comb-like hair-secured frame, which are widened in a fan-shape, being inserted towards the wearer's head portion first with a free end side thereof and the wearer's own hair being blended with the false hairs.

18. A wearer's own hair utilizing type wig according to claim 17, wherein said hair-secured frame is expansible and contractible in a widthwise direction.

19. A wearer's own hair utilizing type wig according to claim 16, wherein each of said ribs is composed of an elastic core material which is made of a rigid material and a thermally-contractive tube convering the core materials

20. A wearer's own hair utilizing type wig according to claim 16, wherein said skeleton-like framework is curved in a lengthwise direction along a configuration of the wearer's head.

21. A wearer's own hair utilizing type wig in which for attachment, the wearer's own hair is pulled up through a space in the wig and blended with false hair attached to said wig, said wig comprising:

a U- or V-shaped hair-secured frame unit no perimeter, said U- or V-shaped hair-secured frame including a skeleton-like framework and a plurality of false hairs attached to said skeleton-like framework, said skeleton-like framework including a rib bent in a U- or V-shaped in such a manner as not to form an outline of said wig, said rib in a U- or V-shaped of said skeleton-like framework being curved in a lenghtwise direction along a confiruation of the wearer's head., for attachment, said U- or V-shaped hair-secured frame unit being inserted towards the wearer's head portion first with a free end side thereof and the wearer's own hair blended with the false hair.

22. A wearer's own hair utilizing type wig according to claim 21, wherein a plurality of ribs are branched out from branches of said U- or V-shaped rib and extend away from said U- or V-shaped rib.

23. A wearer's own hair utilizing type wig according to claim 21 or 16, wherein each said ribs is composed of an elastic core material which is made of a rigid material and a thermally-contracting tube covering the core material.

24. A wearer's own hair utilizing type wig according to claim 21 or 16, wherein said skeleton-like framework is curevd in a lengthwise direction along a configuration of the wearer's head.

25. A wearer's own hair utilizing type wig comprising a hair-secured frame, said hair-secured frame including at least two hair-secured annular frame units connected together arranged laterally and parallel to each other, each of said hair-secured annular frame units including an annular framework and false hairs attached thereto, for attachment, said hair-secured frame unit being placed on a wearer's head and the wearer's own hair is pulled up through an opening of each of said hair-secured frame units and blended with the false hairs.

26. A wearer's own hair utilizing type wig according to claim 25, wherein said hair-secured frame has an elastic property so that it is contracted in a lengthwise direction when it is expanded in a widthwise direction, and two frameworks, which are located at opposite side ends, among all of said framework constituting said hair-secured frame, are each provided with a stopper member for securing said hair-secured frame to the wearer's own hair, for attachment of said hair-secured frame to the wearer's head, said stopper member being secured to the wearer's own hair in a state in which said hair-secured frame is pulled in a widthwise direction so as to be expanded in the widthwise direction.

27. A wearer's own hair utilizing type wig according to claim 25, wherein said rib comprises a core material which is composed of an elastic rigid material and a thermally-contracting tube coated on a peripheral surface of said core material, and wherein said tube projects from opposite ends of said rib and projected parts of said tube are connected together, thereby constituting said hair-secured frame.

28. A wearer's own hair utilizing type wig according to claim 25, wherein each of said frame units has an elliptical shape with sharpened front and rear ends.

29. A wearer's own hair utilizing type wig according to claim 25, wherein the annular framework of each of said hair-secured annular frame units is made of a fine wire rod.

30. A wearer's own hair utilizing type wig comprising a hair-secured frame unit which includes a framework having an elliptic shape with sharpened front and rear ends, and a plurality of false hairs attached to said framework, for attachment, said hair-secured frame unit being placed on a wearer's head, and the wearer's own hair being pulled up through an operating thereof and blended with the false hairs.

31. A wearer's own hair utilizing type wig comprising to claim 30, or 25, wherein each of said framework is formed by bending a rib in an annular shape, connecting opposite ends thereof and curving said rib in a longitudinal direction along a configuration of the wearer's head.

32. A wearer's own hair utilizing type wig according to claim 30 or 25, wherein each of said framework is formed by bending two ribs, connecting opposite ends thereof to thereby form an annular shape and then curving said ribs in a longitudinal direction along a configuration of the wearer's head.

33. A wearer's own hair utilizing type wig according to any one of claims 30, 25, 31, or 32, wherein said rib comprising a core material which is composed of an elastic rigid material and a thermally-contracting tube coated on a peripheral surface of said core material.

34. A wearer's own hair utilizing type wig comprising an annular peripheral edge framed member and a plurality of ribs, said ribs each comprising a core material which is composed of an elastic rigid material and a thermally-contracting tube covering said core material, said peripheral edge framed member having a plurality of support formed in an inner peripheral edge corresponding to a wearer's forehead portion or rear potion, said support holes being adapted to support said ribs, opposite end portions of said ribs being inserted into said support holes and supported by said peripheral edge framed member, said peripheral framed member and said ribs having false hairs attached thereto, for attachment, the wearer's own hair being pulled up through a space between said ribs and blended with the false hairs.

35. A method for manufacturing a wearer's own hair utilizing type wig comprising the steps of:

forming a groove on a head mold having a predetermined configuration along a predetermined framework pattern;

pouring molten material forming a rib into said groove and hardening the same, thereby forming a curved framework along said head mold; and forming a hair-secured frame by attaching a plurality of false hairs to said curved framework.

36. A wearer's own hair utilizing type wig comprising an annular peripheral edge framed member and a plurality of ribs, said ribs each comprising a core material which is composed of an elastic rigid material and a thermally-contracting tube covering said core material, said ribs being attached to said peripheral edge framed member such that said ribs extend forward and backward in a region surrounded with an inner peripheral edge of said peripheral edge framed memeber, a guide thin wire being arranged at each opposite side of said peripheral edge framed member, a slide rib being slidably disposed along said guide thin wire, said peripheral edge framed member, said ribs and said slide rib being attached with false hairs, for attachment, the wearer's own hair being pulled through a space between said ribs and blended with the false hairs.

37. A wearer's own hair utilizing type wig comprising an annular peripheral edge framed member and a plurality of ribs, said ribs each comprising a core material which is composed of an elastic rigid material and a thermally-contracting tube covering said core material, said ribs being arranged in a mutually crossing relation within a region surrounding with and inner peripheral edge of said peripheral edge framed member, said ribs being attached to said peripheral edge framed member without being connected at crossing points thereof so that said ribs can freely exhibit elasticity thereof without being interfered with their mutal actions, said peripheral edge framed portion and said ribs being attached with false hairs, for attachment, the wearer's own hair being pulled up through a space between said ribs and blended with the false hairs.

38. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, for attachment, the wearer's own hair being pulled up through a space of said hair-secured frame and blended with the false hairs secured to said skeleton-like framework, wherein said skeleton-like framework includes a plurality of ribs arranged in parallel to each other and an annular connecting rib crossing for connection with each of said plurality of ribs at two points such that the end portions of said ribs project outward, the false hairs being attached to both said plurality of ribs and said annular connecting rib.

39. A wearer's own hair utilizing type wig according to claim 38, wherein each of said plurality of ribs extends forward and/or backward in correspondence with at least a forehead portion and/or a rear head portion of the wearer's head.

40. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework being constituted by a plurality of ribs each made of fine wire rod, said plurality of ribs being combined together in such a manner as not to form an outline of said wig, for attachment, the wearer's own hair being pulled up through a space of said hair-secured frame and blended with the false hairs attached to said skeleton-like framework, wherein said plurality of ribs are combined for connection with each other so as to conform to the wearer's hairstyle.

41. A wearer's own hair utilizing type wig according to claim 40, wherein each of said plurality of ribs extends forward and/or backward in correspondence with at least a forehead portion and/or a rear head portion of the wearer's head.

42. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including a plurality of ribs combined together in such a manner as not to form an outline of said wig, for attachment, the wearer's own hair being pulled up through a space of said hair-secured frame and blended with the false hairs attached to said skeleton-like framework, wherein adjacent ribs among said plurality of ribs arranged parallel to each other are combined at a larger interval in a given peripheral area of a hair-dividing part than the predetermined intervals between the adjacent remaining ribs.

43. A wearer's own hair utilizing type wig according to claim 42, wherein each of said plurality of ribs extends forward and/or backward in correspondence with at least a forehead portion and/or a rear head portion of the wearer's head.

44. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including a plurality of ribs combined together in such a manner as not to form an outline of said wig, for attachment, the wearer's own hair being pulled up through a space of said hair-secured frame and blended with the false hairs attached to said skeleton-like framework, wherein said plurality of ribs extends in general, parallel to each other, each of said ribs being bent away from a contour of the wearer's head at a lengthwise intermediate part thereof and curved from the bent part towards a distal end along a contour of the wearer's head such that a distal end thereof contacts the scalp of the wearer.

45. A wearer's own hair utilizing type wig according to claim 44, wherein each of said plurality of ribs extends forward and/or backward in correspondence with at least a forehead portion and/or a rear head portion of the wearer's head.

46. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including a plurality of ribs combined together in such a manner as not to form an outline of said wig, for attachment, the wearer's own hair being pulled up through a space of said hair-secured frame and blended with the false hairs attached to said skeleton-like framework, wherein a hair-implanted section made of a net member or an artificial skin is stretched between said adjacent ribs, and the false hairs are attached to the hair-implanted section.

47. A wearer's own hair utilizing type wig according to claim 46, wherein each of said plurality of ribs extends forward and/or backward in correspondence with at least a forehead portion and/or a rear head portion of the wearer's head.

48. A method for manufacturing a wearer's own hair utilizing type wig comprising the steps of:

forming a planar skeleton-like framework having no outline by connecting together a plurality of ribs and at least one connecting rib by proper means such as bonding, knotting, welding and the like along a predetermined framework pattern;

placing said skeleton-like framework on a head mold having a predetermined configuration and retainingly the curve along the configuration of said head mold;

molding a curved framework, which is curved along the configuration of said head mold, by heating, for a predetermined time, said ribs at a temperature for the material forming said ribs to be thermally changed; and forming a hair-secured frame by attaching a plurality of false hairs to said curved framework, wherein a groove is formed on said head mold along said predetermined framework pattern, and said planar skeleton-like framework is retained in said groove.

49. A wearer's own hair utilizing type wig comprising a net member or a wig base composed of an artificial skin and a plurality of false hairs attached to said wig base, said wig base being formed at a portion thereof with a cutout section, a rib, which comprises a core material composed of an elastic rigid material and a thermally-contraction tube covering said core material, being disposed over said cutout section, said rib being attached with false hairs, for attachment, the wearer's own hair being pulled up through said cutout section and blended with the false hairs attached to said rib and wig base.

50. A wearer's own hair utilizing type wig in which for attachment, the wearer's own hair is pulled up through a space in the wig and blended with false hair attached to said wig comprising:

a U- or V-shaped hair-secured frame unit having no perimeter, said U- or V-shaped hair-secured frame including a skeleton-like framework and a plurality of false hairs attached to said skeleton-like framework, said skeleton-like framework including a rib bent in U- or V-shaped in such a manner as not to form an outline of said wig and a plurality of ribs branched out from branches of said U- or V-shaped rib and extending away from said U- or V-shaped rib, for attachment, said U- or V-shaped hair-secured frame unit being inserted towards the wearer's head portion first with a free end side thereof and the wearer's own hair being blended with the false hairs.

51. A method for manufacturing a wearer's own hair utilizing type wig comprising the steps of:

forming a planar skeleton-like framework having no outline by connecting together a plurality of ribs and at least one connecting rib by proper means such as bonding, knotting, welding and the like along a predetermined framework pattern, said plurality of ribs and said at least one connecting rib being in a thermoformable material;

placing said skeleton-like framework on a head mold having a predetermined configuration and retainingly the curve along the configuration fo said head mold;

molding a curved framework, which is curved along the configuration of said head mold, by heating, for a predetermined time, said ribs at a temperature for the material forming said ribs to be thermally changed; and forming a hair-secured frame by attaching a plurality of false hairs to said curved framework.

52. A method for manufacturing a wearer's own hair utilizing type wig according to claim 51, wherein a groove is formed on said head mold along said predetermined framework pattern, and said planar skeleton-like framework is retained in said groove.

53. A method for manufacturing a wearer's own hair utilizing type wig according to claim 51, wherein the material forming said ribs is a nylon filament and the nylong filament is heated at a heating temperature of 150 degress C. to 170 degress C. for ranging from 30 minutes to 4 hours.

54. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including at least one rib curved or bent in such a manner as not to form an outline of said wig, for attachment, the wearer's own hair being pulled up through a space hair-secured frame and blended with the false hairs attached to said skeleton-like framework, wherein said at least one rib has a swollen part at a free end thereof.

55. A wearer's own hair utilizing type wig according to claim 54, wherein said skeleton-like framework includes a plurality of ribs.

56. A wearer's own hair utilizing type wig according to claim 55, wherein each said plurality of ribs extends forward and/or backward in correspondence with at least a forehead portion and/or a rear head portion of the wearer's head.

57. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework being constituted by at least one rib made of a fine wire rod, said skeleton-like framework including at least one rib curved or bent in such a manner as not to form an outline of said wig, for attachment, the wearer's own hair being pulled up through a space of said hair-secured frame and blended with the false hairs attached to said skeleton-like framework, wherein said least one rib is composed of an elastic core material which is made of a rigid material and a thermally-contractible tube covering the core material.

58. A wearer's own hair utilizing type wig according to claim 57, wherein said skeleton-like framework includes a plurality of ribs.

59. A wearer's own hair utilizing type wig according to calim 58, wherein each of said plurality of ribs extends forward and/or backward in correspondence with at least a forehead portion and/or a rear head portion of the wearer's head.

60. A wearer's own hair utilizing type wig in which for attachment, the wearer's own hair is pulled up through a space in the wig and blended with false hair attached to said wig, said wig comprising a hair-secured frame having no perimeter, said hair-secured frame including a skeleton-like framework and a plurality of false hairs fixed to said skeleton-like framework, said skeleton-like framework including at least one rib curved or bent in such a manner as not to form an outline of said wig, for attachment, the wearer's own hair being pulled up through a space of said hair-secured frame and blended with the false hairs attached to said skeleton-like framework, wherein said at least one rib includes a false hair attachment loop at a free end thereof.

61. A wearer's own hair utilizing type wig according to claim 60, wherein said skeleton-like framework including a plurality of ribs.

62. A wearer's own hair utilizing type wig according to claim 61, wherein each of said plurality of ribs extends forward and/or backward in correspondence with at least a forehead portion and/or a rear head portion of the wearer's head.

* * * * *